US005892390A

United States Patent [19]

Tobita

[11] Patent Number: 5,892,390

[45] Date of Patent: Apr. 6, 1999

[54] INTERNAL POWER SUPPLY CIRCUIT WITH LOW POWER CONSUMPTION

[75] Inventor: Yoichi Tobita, Hyogo, Japan

[73] Assignee: Mitsubishi Denki Kabushiki Kaisha, Tokyo, Japan

[21] Appl. No.: 971,572

[22] Filed: Nov. 17, 1997

Related U.S. Application Data

[63] Continuation of Ser. No. 605,408, Feb. 22, 1996, abandoned.

[30] Foreign Application Priority Data

Jul. 11, 1995 [JP] Japan ..... 7-174775

[51] Int. Cl.[6] ..... G05F 3/02

[52] U.S. Cl. ..... 327/543; 327/538; 327/541; 323/315

[58] Field of Search ..... 327/538, 540, 327/541, 543; 323/315

[56] References Cited

U.S. PATENT DOCUMENTS

| | | | |
|---|---|---|---|
| Re. 34,290 | 6/1993 | Tobita | 323/313 |
| 3,806,742 | 4/1974 | Powell | 327/541 |
| 4,812,735 | 3/1989 | Sawada et al. | 323/313 |
| 5,117,177 | 5/1992 | Eaton, Jr. | 323/314 |
| 5,362,988 | 11/1994 | Hellums | 327/543 |
| 5,534,817 | 7/1996 | Suzuki et al. | 327/543 |
| 5,610,550 | 3/1997 | Furutani | 327/543 |

FOREIGN PATENT DOCUMENTS

| | | |
|---|---|---|
| 1-140212 | 6/1989 | Japan . |
| 3-180915 | 8/1991 | Japan . |
| 5-303438 | 11/1993 | Japan . |
| 6-138965 | 5/1994 | Japan . |

OTHER PUBLICATIONS

*Microelectronics* Second Edition, pp. 155–160, 1988 by Jacob Millman and Arvin Grabel, published by McGraw–Hill International Editions, ISBN 0–07–100596–X.

*Primary Examiner*—Terry D. Cunningham
*Attorney, Agent, or Firm*—McDermott, Will & Emery

[57] ABSTRACT

An internal power supply circuit includes a first output MOS transistor for transmitting a first reference voltage in a source follower mode, an internal reference voltage generating circuit for generating a second reference voltage from the output voltage of the first MOS transistor, and an output MOS transistor coupled between a power supply node and an output node and operating in the source follower mode in accordance with the second internal reference voltage. Internal reference voltage generating circuit has a function of canceling an influence of the threshold voltages of output MOS transistor and the first MOS transistor on the internal voltage VINT on the output node. Since comparing circuit for comparing the internal voltage and the reference voltage is not used, current consumption necessary for the comparing operation can be reduced.

19 Claims, 14 Drawing Sheets

$|VTPa| < |VTPb|$

INTERNAL POWER SUPPLY CIRCUIT WITH LOW POWER CONSUMPTION

This application is a continuation of application Ser. No. 08/605,408, filed Feb. 22, 1996, now abandoned.

BACKGROUND OF THE INVENTION

1. Field of the Invention

The present invention relates to a circuit for generating a voltage of a prescribed level in a semiconductor device. More specifically, it relates a structure of an internal power supply circuit generating an internal power supply voltage by lowering an external power supply voltage, and especially to a structure of an internal power supply circuit with low power consumption.

2. Description of the Background Art

In a semiconductor integrated circuit, a voltage source is required in some cases which supplies a voltage of a prescribed voltage level not dependent on an external power supply voltage. One of such cases is as follows. In order to achieve higher density and higher degree of integration, semiconductor elements which are the components are miniaturized. The miniaturized semiconductor element has its break down voltage decreased, and therefore power supply voltage (operational power supply voltage) of a semiconductor integrated circuit including such miniaturized semiconductor elements as its components must be lowered. However, it is impossible in a certain case to lower an external power supply voltage in practice. For example, in a DRAM (Dynamic Random Access Memory) having large storage capacity, the power supply voltage (operational power supply voltage) is lowered in view of break down voltage of the elements, speed of operation and power consumption. However, a microprocessor and a logic LSI (Large Scale Integrate Circuit), which are external devices, have their components not so much miniaturized as compared with DRAM, and hence the power supply voltage for these devices cannot be made as low as the power supply voltage of the DRAM. Therefore, when a system is to be constructed by using the DRAM, a microprocessor and the like, a power supply voltage of a higher voltage level required by the microprocessor and a logic LSI is used as the system power supply source.

When the system power supply source, that is, the external power supply voltage is relatively high, a circuit (an internal voltage down converter) for generating an internal power supply voltage by internally lowering the external power supply voltage is provided in a semiconductor device such as the DRAM or the like which requires lower operational power supply voltage.

FIG. 20 schematically shows a whole structure of a semiconductor device, which is, for example, a DRAM including such an internal voltage down converter. Referring to FIG. 20, a semiconductor device 900 includes an external power supply line 902 for transmitting an external power supply voltage EXV applied to a power supply terminal 901; one power supply line (hereinafter referred as ground line) 904 for transmitting one power supply voltage (hereinafter referred to as the ground voltage) Vss applied to one power supply terminal (hereinafter referred to as the ground terminal 903; and internal voltage down converter 905 which operates using both voltages EXV and Vss on external power supply line 902 and the ground line 904 as two operation power supply voltages, lowering (down-converting)the external power supply voltage EXV for generating an internal power supply voltage VCI. The structure of the internal voltage down converter 905 will be described later. The internal voltage down converter 905 has a function of generating an internal power supply voltage VCI which is, with the external power supply voltage EXV being within a prescribed range, stable and not influenced by the fluctuation of the external power supply voltage.

The semiconductor device 900 further includes a circuit 907 using internal power supply, which operates using voltages VCI and Vss on internal supply line 906 and ground line 904 as two operational power supply voltages, and a circuit 908 using external power supply which operates using the external power supply voltage EXV on eternal power supply line 902 and the ground voltage Vss on the ground line 904 as two operational power supply voltages. The circuit 908 using the external power supply is connected to an input/output terminal 909 and has a function of providing an interface with an external device. As an internal power supply voltage VCI of a prescribed voltage level is generated by using internal voltage down converter 905 in semiconductor device 900, breakdown voltage characteristics of the elements included in the circuit 907 using internal power supply, which are the main components, can be ensured, the speed of operation can be improved as the signal amplitude is made small, and power consumption is reduced.

FIG. 21 schematically shows a structure of internal voltage down converter 95 shown in FIG. 20. Referring to FIG. 21, internal voltage down converter 905 includes a reference voltage generating circuit 910 for generating a reference voltage vref of a prescribed voltage level from the external power supply voltage EXV applied to external power supply terminal 901; a comparing circuit 912 for comparing internal power supply voltage VCI on internal power supply line 906 with the reference voltage Vref; and a drive element 914 consisting of a p channel MOS transistor (insulated gate type field effect transistor) 914 for supplying current from external power supply terminal 901 to internal power supply line 906 in accordance with an output signal from comparing circuit 912. Comparing circuit 912 receives at its positive input the internal power supply voltage VCI on internal power supply 906, and at its negative input, the reference voltage Vref. Generally, comparing circuit 912 is formed by a differential amplifying circuit, and it differentially amplifies the internal power supply voltage VCI and the reference voltage Vref. The operation will be briefly described.

From the reference voltage generating circuit 910, a reference voltage Vref of a prescribed voltage level, which is not dependent on the external power supply voltage EXV if the voltage EXV falls within a predetermined voltage region is generated. If the internal power supply voltage VCI on internal power supply line 906 is higher than the reference voltage Vref, an output from comparing circuit 12 attains to a high level, and drive element 914 is turned off. In this state, current is not supplied from external power supply terminal 901 to internal power supply line 906. Meanwhile, if internal power supply voltage VCI is lower than the reference voltage Vref, the output signal from comparing circuit 912 attains to a low level in accordance with the difference between the internal power supply voltage VCI and reference voltage Vref, conductance of drive element 914 is increased (turned on), the drive element 914 supplies current from external power supply terminal 901 to internal power supply line 906, so that the voltage level of internal power supply voltage line 906 is increased. By the feedback loop formed by comparing circuit 912, drive element 914 and internal power supply line 906, internal power supply voltage VCI is maintained at the voltage level of reference voltage Vref.

FIG. 22 shows an example of a specific structure of comparing circuit 912 shown in FIG. 21. Referring to FIG. 22, comparing circuit 912 includes n channel MOS transistors NT1 and NT2 constituting a differential stage for comparing internal power supply voltage VCI with the reference voltage Vref, and p channel MOS transistors PT3 and PT4 constituting a current mirror circuit for supplying current to transistors NT1 and NT2. MOS transistor PT3 supplies current from external power supply line 902 to MOS transistor NT1. MOS transistor PT4 supplies current from external power supply line 902 to MOS transistor NT2. MOS transistors NT1 and NT2 have their sources connected to the ground line 904 through a current source CT5. MOS transistor PT3 has its gate and drain connected to each other, and provides a master stage of the current mirror circuit. When MOS transistors PT3 and PT4 have the same size, a current having the same magnitude as the current flowing through MOS transistor PT3 flows through MOS transistor PT4.

The operation will be briefly described. When internal power supply voltage VCI is higher than reference voltage Vref, conductance of MOS transistor NT1 becomes higher than that of MOS transistor NT2, and current flowing through MOS transistor NT1 becomes larger than the current flowing through MOS transistor NT2. MOS transistor NT1 is supplied with current from MOS transistor PT3. MOS transistor PT4 supplies a mirror current of the current flowing through MOS transistor PT3 to MOS transistor NT2. MOS transistor NT2 cannot discharge all the current supplied from MOS transistor PT4, so that potential at node 920 increases, conductance of drive element 914 shown in FIG. 21 decreases, and current supply from external power supply terminal 901 to internal power supply line 906 is reduced or stopped.

Meanwhile, if the internal power supply voltage VCI is lower than the reference voltage Vref, conversely the current flowing through MOS transistor NT2 becomes larger than the current flowing through MOS transistor NT1. Since MOS transistor PT3 supplies the current flowing through MOS transistor NT1, the current flowing through MOS transistor PT4 becomes smaller accordingly, and the current from MOS transistor PT4 is all discharged to the ground line 904 through MOS transistor NT2 and current source CT5. Therefore, potential at node 920 lowers, conductance of drive element 914 is increased, and current is supplied from external power supply terminal 901 to internal power supply line 906.

When comparing circuit 912 is formed by using above described current mirror type differential amplifier, a constant current flows through a constant current source CT5 between external power supply line 902 and ground line 904. By shutting off the constant current source CT5 in a stand-by cycle, it is possible to reduce current consumption in comparing circuit 912. However, in an active cycle in which the semiconductor device actually operates, a constant current continuously flows from external power supply line 902 to ground line 912, and as the current mirror type differential amplifier is a current driving circuit requiring relatively large current flowing therethrough (in order to change the potential at node 920 at high speed), the constant current source CT5 must provide relatively large current. This results in relatively large current consumption.

The above described problem arises in a circuit generating an internal voltage of a prescribed voltage level by driving a drive element by using a current mirror type differential amplifying circuit.

SUMMARY OF THE INVENTION

An object of the present invention is to provide an internal power supply circuit capable of generating an internal voltage of a prescribed voltage level with low power consumption.

Another object of the present invention is to provide an internal voltage lowering circuit with low power consumption.

An internal power supply circuit in accordance with a first aspect includes a first MOS transistor of a first conductivity type receiving at its gate a first reference voltage; at least one second MOS transistor of a second conductivity type coupled between the first MOS transistor and a first internal node, each operating in a diode mode; an output MOS transistor connected between a power supply node and an internal voltage output node; and internal reference voltage generator for generating a second reference voltage from a voltage of the first internal node and for applying the generated reference voltage to the gate of the output MOS transistor. The internal reference voltage generator includes a circuit for canceling influence of threshold voltages of first, second and output MOS transistors on the voltage value output at the internal voltage output node.

An internal power supply circuit in accordance with a second aspect includes a first p channel MOS transistor receiving at its gate a first reference voltage; an n channel output MOS transistor connected between a power supply node and an internal voltage output node; and an internal reference voltage generator generating a second reference voltage from a voltage of the first MOS transistor and for applying the generated reference voltage to the gate of the output MOS transistor. The internal reference voltage generator includes at least one n channel MOS transistor connected between the first MOS transistor and a first internal node, each operating in a diode mode, and a circuit for canceling influence of threshold voltages of the first, second and an output MOS transistors on the voltage value output at the internal voltage output node.

An internal power supply circuit in accordance with a third aspect includes a p channel MOS transistor receiving at its gate a first reference voltage and operating in a source follower mode to generate a second reference voltage higher than the first reference voltage, and an n channel output MOS transistor receiving at its gate the source potential of the first MOS transistor and operating in a source follower mode in which current is supplied from a power supply node to an internal voltage output. The first MOS transistor has its source coupled to receive a voltage higher than the voltage applied to the power supply node through a resistance element.

An internal power supply circuit in accordance with a fourth aspect includes an n channel first MOS transistor receiving at its gate a first reference voltage, transmitting the first reference voltage in a source follower mode for generating a reference voltage lower than the first reference voltage; an n channel first output MOS transistor coupled between a power supply node and an internal voltage output node and operating in the source follower; and first internal reference voltage generator for generating a second reference voltage higher than the first reference voltage from the voltage transmitted by the first MOS transistor and applying the generated reference voltage to the gate of the first output MOS transistor. The internal reference voltage generator includes a circuit for canceling influence of threshold voltages of the first MOS and the first output MOS transistors on the value of the internal voltage on the internal voltage output node.

According to the first aspect of the present invention, the internal reference voltage generator generates the second reference voltage from the voltage output from the first MOS transistor operating in the source follower mode, and applies the generated voltage to the gate of the output MOS transistor. The output MOS transistor supplies current from the power supply node to the internal voltage output node in accordance with a difference between its gate potential and the voltage on the internal voltage output node. Therefore, the output MOS transistor itself compares the reference voltage with the internal voltage and supplies current to the internal voltage output node in accordance with the result of comparison, and hence, unlike the prior art, it is not necessary to use a current mirror type differential amplifier as a comparing circuit. The internal reference voltage generator simply generates and applies to the gate of the output MOS transistor the second reference voltage from the first reference voltage, and hence current consumption can be reduced. Further, since the influence of the threshold voltages of the MOS transistors on the voltage level of the internal voltage is canceled, even when operational characteristics of the MOS transistors deviate because of variation in manufacturing parameters, an internal voltage of a desired voltage level can be generated stably without any influence by such deviation.

According to the second aspect of the present invention, the second reference voltage is generated from the voltage output from the p channel first MOS transistor operating in the source follower mode, and the second reference voltage is applied to the gate of the n channel output MOS transistor. The first MOS transistor simply transmits the first reference voltage applied to its gate in the source follower mode for generating a desired voltage, and hence current consumption is small. The output MOS transistor receives the second reference voltage at its gate and operates in the source follower mode. That is, the n channel output MOS transistor operates in the source follower mode, generates an internal voltage lower than the voltage applied to the power supply node, and transmits the generated internal voltage to the internal voltage output node. The output MOS transistor itself compares the internal voltage of the second reference voltage, current is not at all consumed for comparison, and hence low current consumption characteristic is realized. The internal reference voltage generator simply generates the second reference voltage from the voltage generated by the first MOS transistor, and what is required is simply to drive the gate potential of the output MOS transistor. Therefore, only a small current drivability is required, and the second reference voltage can be generated with low current consumption. Further, since the influence of the threshold voltages of the first MOS transistor and the output MOS transistor on the voltage level of the internal voltage is canceled by the internal reference voltage generator, even when main characteristics of the MOS transistors deviate because of variation in manufacturing parameters, an internal voltage of a desired voltage level can be generated stably without any influence of such fluctuation.

According to the third aspect of the present invention, the first MOS transistor operates in the source follower mode, generates the second reference voltage higher than the first reference voltage from the first reference voltage. Therefore, large current is not necessary to generate the second reference voltage due to the source follower mode operation. Therefore, the second reference voltage can be generated with low current consumption. In accordance with the second reference voltage, the output MOS transistor operates in the source follower mode, and supplies current from the power supply node to the internal voltage output node, and hence only the voltage lower by the threshold voltage of the output MOS transistor than the second reference voltage is output to the internal voltage output node. What takes place is only that the output MOS transistor operating in the source follower mode generates an internal voltage of a desired voltage level, and any comparing circuit for comparing the internal voltage with the reference voltage is not necessary, whereby the current consumption can be reduced. The first MOS transistor receives a voltage higher than the voltage at the power supply node through a resistance element. Therefore, even when the difference between the first reference voltage and the voltage applied to the power supply node is small, the second reference voltage can be stably generated and applied to the output MOS transistor, and hence an internal voltage of a desired voltage level can be stably generated even in an operational environment in which the voltage applied to the power supply node is low.

According to the fourth aspect of the present invention, the first MOS transistor transmits the first reference voltage in the source follower mode, large current consumption is not required in the first MOS transistor, and the first MOS transistor can generate a desired voltage level with small current. The output MOS transistor operates in the source follower mode and supplies current from the power supply node to the internal voltage output node, in accordance with the second reference voltage from the internal reference voltage generator, and at the internal voltage output node, a voltage determined by the threshold voltage of the output MOS transistor and by the value of the second reference voltage is output stably. Since the output MOS transistor itself performs comparison, a comparing circuit for comparing the internal voltage and a reference voltage is not necessary, and hence current consumption is reduced. Further, since the internal reference voltage generator is adapted to cancel the influence of the threshold voltages of the first MOS transistor and the first output MOS transistor on the internal voltage, the internal voltage has a voltage level determined only by the first reference voltage, and therefore an internal voltage of a desired voltage level can be generated stably without any influence of deviation of the threshold voltages of the MOS transistors caused by variation in manufacturing parameters.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
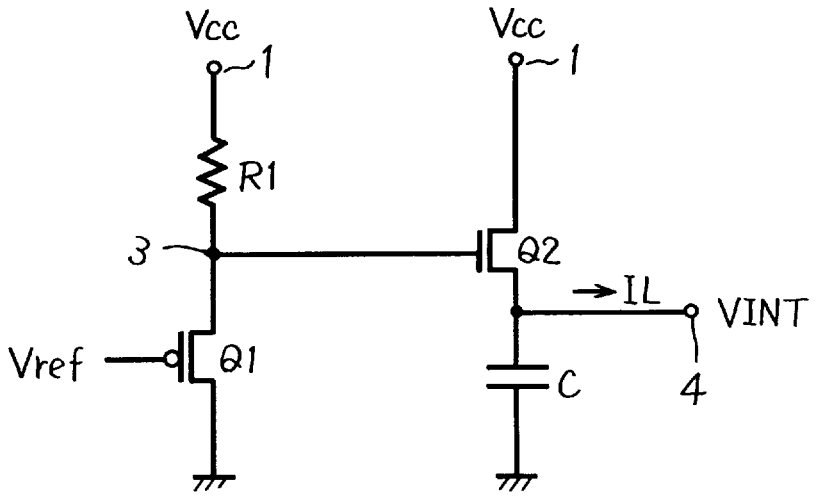
FIG. 1 shows a structure of an internal power supply circuit in accordance with a first embodiment of the present invention.

The present invention is most suitably applied to an internal power supply voltage generating circuit (internal voltage lowering circuit (down converter) for generating an internal power supply voltage from an external power supply voltage. However, it is also applicable to a circuit for generating an internal voltage from a voltage applied to a power supply node (internal voltage supply node), and in the following description, the voltage applied to the power supply node will be denoted by the reference character "VCC".

[First Embodiment]

FIG. 1 shows a structure of an internal power supply circuit in accordance with the first embodiment of the present invention. Referring to FIG. 1, the internal power supply circuit includes a p channel MOS transistor (first MOS transistor) Q1 coupled between an internal node 3 and a ground node and receiving at its gate a reference voltage (first reference voltage) vref; a resistance element R1 of high resistance coupled between a power supply node 1 and an internal node 3; an n channel MOS transistor (output MOS transistor) Q2 coupled between the power supply node 1 and an internal voltage output node 4 and receiving at its gate the voltage on internal node 3; and a capacitance C coupled between internal voltage output node 4 and the ground node.

Resistance element R1 has sufficiently larger resistance value than a conduction resistance (channel resistance) of MOS transistor Q1. The resistance value of resistance element R1 should preferably be as large as possible, within the allowable range of the area of occupation (for example, 10 MΩ: at this state, if the power supply voltage VCC is 5 V, the current flowing through resistance element R1 would be 0.5 μA, and hence quite low consumption can be realized). To the MOS transistor Q1, only a small current is supplied through resistance element R1, the transistor Q1 operates in the saturation region, and the gate-source voltage thereof becomes equal to the absolute value of the threshold voltage VTP. Namely, the MOS transistor Q1 operates in the source follower mode. In the following description, "operate in the source follower mode" means a state in which "difference between the gate potential and the source potential of an MOS transistor becomes equal to the absolute value of the threshold voltage of the MOS transistor."

Therefore, the voltage V3 at node 3 can be approximately represented by the following equation (1).

$$V3=Vref+|VTP| \tag{1}$$

MOS transistor Q2 has its gate potential lower than the drain potential (voltage VCC at power supply node 1), and it operates in the saturation region in source follower mode. Therefore, the source voltage of the MOS transistor Q2, that is, internal voltage VINT of internal voltage output node (hereinafter simply referred to as an output node) 4 can be represented by the following equation (2).

$$VINT=V3-VTN=Vref+|VTP|-VTN \tag{2}$$

where VTN represents the threshold voltage of the MOS transistor Q2.

In equation (2), three terms Vref, |VTP| and VTN on the rightmost side all have constant values not dependent on the power supply voltage VCC. Therefore, the internal voltage VINT output from the output node 4 will be a constant voltage not dependent on the power supply voltage VCC. The second and third terms of the rightmost side of equation (2) have approximately the same value and temperature coefficients thereof are approximately the same, and hence difference value |VTP|−VTN is approximately 0. Here, generally, an MOS transistor has a temperature dependency such that the absolute value of the threshold voltage becomes smaller as the temperature increases. If the reference voltage Vref applied from a reference voltage generating circuit, not shown, does not have temperature dependency, the temperature dependency of the internal voltage VINT is also approximately 0, and hence a constant voltage level is maintained at output node 4 regardless of the operational temperature.

As is generally known, what is most important of the characteristics required for a power supply circuit is the feature of fluctuation of the output voltage when a load current IL flows. The characteristic when the load current IF flows to the output node 4 will be described in the following.

When we represent output voltage when load current IL flows through output node 4 by VINT', the load current IL can be represented by the following equation (3), in accordance with the square characteristic of drain current.

$$IL = (\beta/2)(VINT - VINT')^2 = (\beta/2)(Vref + |VTP| - VTN - VINT')^2 \quad (3)$$

where β is conduction coefficient of MOS transistor Q2, which is represented by the following equation (4).

$$\beta = \beta 0 \cdot W/L \quad (4)$$

β0 represents a unit conduction coefficient represented by mobility of electrons and unit gate capacitance of MOS transistor Q2, and L and W respectively represent gate length and gate width of MOS transistor Q2.

From equation (3), the following equation can be obtained.

$$Vref + |VTP| - VTN - VINT' = (2 \cdot IL/\beta)^{1/2}$$

The internal power supply voltage VINT (=Vref+|VTP|−VNT) is the internal voltage at output node 4 when current does not flow through MOS transistor Q2. In other words, this corresponds to a state in which the gate-source voltage of MOS transistor Q2 is equal to the threshold voltage VTN of MOS transistor Q2, and current hardly flows through MOS transistor Q2 in this state. Therefore, difference AVINT between the internal voltage VINT and VINT' represents voltage fluctuation at the output node 4 when load current IL flows. The voltage fluctuation AVINT can be given by the following equation (5).

$$\Delta VINT = (2 \cdot IL/\beta)^{1/2} \quad (5)$$

As general condition for practical use, when low current IL is 150 mA and fluctuation in voltage ΔVINT is to be set to about 0.1 V, and the unit conduction coefficient β0 of MOS transistor Q2 is about 40 $\mu A/V^2$, the gate width W when the gate length L is set to 0.4 μm is given by the following equation.

$$\begin{aligned} W &= 2 \cdot IL \cdot L/(\beta 0 \cdot (\Delta VINT)^2) \\ &= 2 \cdot 150 \cdot 10^{-3} \cdot 0.4/(40 \times 10^{-6} \cdot 0.1^2) \\ &= 120 \cdot 10^{-3}/(400 \cdot 10^{-9}) \\ &= 0.3 \cdot 10^6\ (\mu m) \end{aligned}$$

Figure 2A:
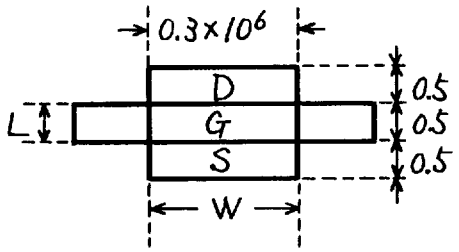
FIGS. 2A to 2C are planar layout of the MOS transistor shown in FIG. 1.

Further, as shown in FIG. 2A, let us consider an example in which the output MOS transistor Q2 is laid out simply. Referring to FIG. 2A, the width W of gate G is determined to be $0.3 \cdot 10^6$ μm, and length L of the gate G and the lengths of drain D and source S are all equally set to 0.5 μm. In this case, the area occupied by the MOS transistor Q2 is 1.5 $\mu m \cdot 3 \cdot 10^5 = 4.5 \cdot 10^5\ \mu m^2$. This occupies only about 0.9% of the area of a semiconductor chip having the common size of 50 $mm^2$. Therefore, MOS transistor Q2 having sufficiently large current supplying capability can be ready implemented without increasing the area of the chip.

Figure 2B:
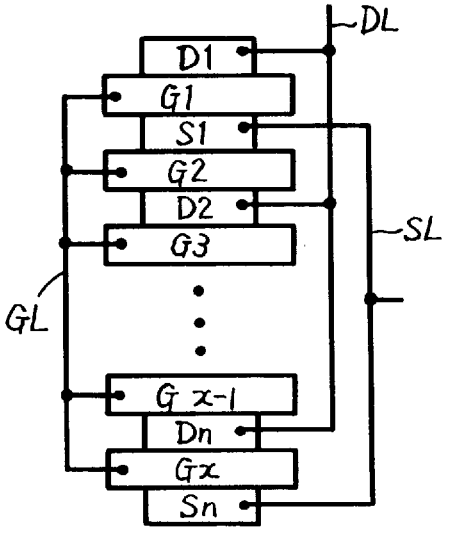

Further, as shown in FIG. 2B, if the MOS transistor Q2 is formed to have a "comb shape", the area occupied by MOS transistor Q2 can be reduced to as small as about ½ times area of FIG. 2A arrangement. Here, referring to FIG. 2B, drain regions D (D1-Dn) and source regions S (Sl-Sn) are arranged alternately and spaced from each other, and between drain region D (Dl-Dn) and source region S (Sl-Sn) adjacent with other, a gate G (Gl-Gx) is arranged. Drain regions Dl to Dn are commonly connected to a drain line DL, source regions Sl to Sn are commonly connected to a source line SL, and gates Gl to Gx are commonly connected to a gate line GL.

Figure 2C:
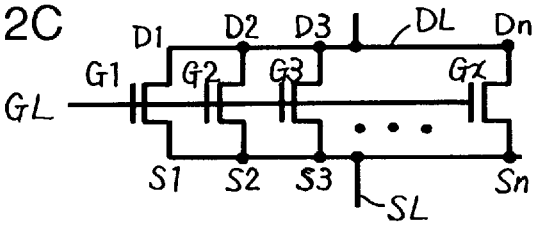

By the connection shown in FIG. 2B, a structure such as shown in FIG. 2C in which a plurality of MOS transistors are connected in parallel can be implemented. In FIG. 2C, the MOS transistors having gates G1 and G2 share source region S1, and MOS transistors having gates G2 and G3 share the drain region D2. Therefore, the number of gates G1 to Gx is approximately double the number of drain regions (or source regions). Therefore, the width of the gate G1-Gx can be made 1/(2·x) of the aforementioned value, the area occupied by the MOS transistor Q2 can be reduced in factor to x·1/(2·x)=½, namely, the area of occupation can be made approximately half.

Figure 3A:
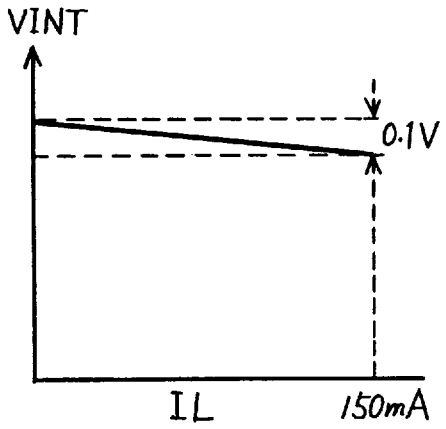
FIGS. 3A and 3B show operational characteristics of the internal power supply circuit shown in FIG. 1.
Figure 3B:
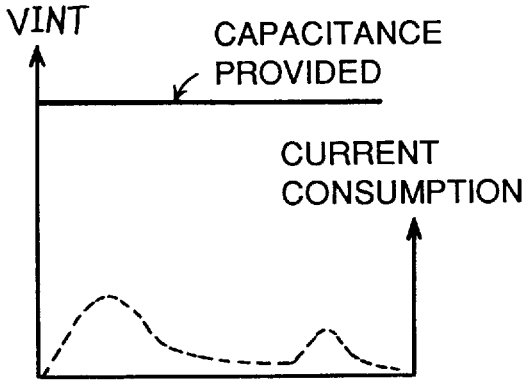

When load current IL changes linearly as shown in FIG. 3A, it is possible to feed the load current IL with sufficiently large current drivability. However, dependent on a circuit utilizing the internal voltage VINT from output node 4, a large current is abruptly consumed by the operation of a circuit which has been in the stand-by state, and the load current (consumed current) IL may change an AC-wise current as shown in FIG. 3B. In order to cope with such an AC-wise change of load current IL, a capacitance C is provided at output node 4. By supplying a current which changes AC-wise with the charges accumulated in capacitance C, delay in response of the MOS transistor Q2 is compensated for, and internal voltage VINT of the constant voltage level is generated. More specifically, by compensating for the current consumption changing AC-wise by the charges in capacitance C, it becomes possible to prevent abrupt lower of the internal voltage VINT caused by the abruptly changing consumed current, and hence internal voltage VINT of a desired voltage level can be supplied stably.

If the current does not abruptly change when the internal circuit (not shown) utilizing the internal voltage VINT from output node 4 operates and the load current IL changes linearly only, or when the current which changes AC-wise is small, it is not necessary to provide capacitance C.

[Modification 1]

Figure 4:
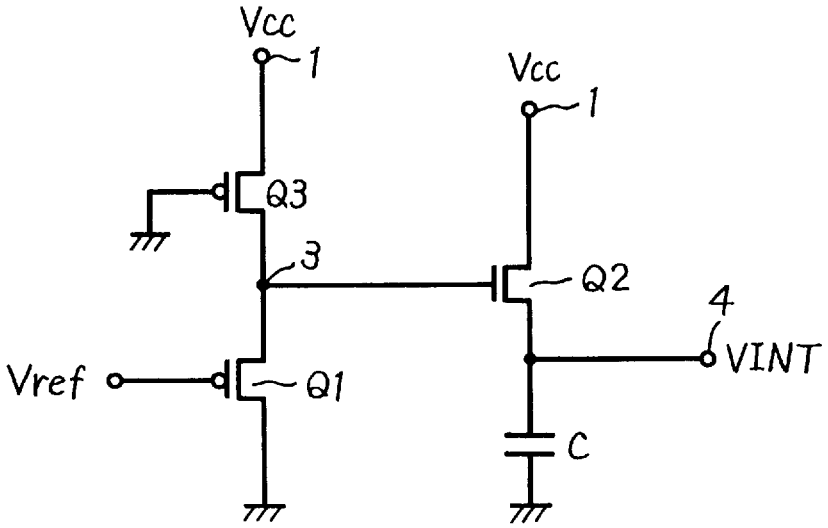
FIG. 4 shows a structure of a first modification of the first embodiment of the present invention.

FIG. 4 shows a structure of a first modification of the internal power supply circuit in accordance with the first embodiment of the present invention. Referring to FIG. 4, a p channel MOS transistor Q3 operating in a resistance mode is arranged between power supply node 1 and internal node 3. MOS transistor Q3 has its gate coupled to the ground potential. By using p channel MOS transistor Q3 in place of resistance element R1 shown in FIG. 1, the following advantages can be obtained. The p channel MOS transistor Q3 employs holes as carriers which has smaller mobility than electrons. Therefore, generally, p channel MOS transistor Q3 has smaller (current) driving capability and smaller conduction coefficient β. Therefore, when p channel MOS transistor Q3 is used, resistance value per unit area can be made sufficiently large as compared with a case where a polysilicon type resistance element is used. Accordingly, the area of occupation by the resistance element can be reduced. The conduction resistance of MOS transistor Q3 (channel resistance: MOS transistor Q3 has its gate connected to the ground potential and MOS transistor Q3 is normally on) can be set to an appropriate value by adjusting the surface impurity concentration of the channel region.

As MOS transistor Q3, an n channel MOS transistor having its gate electrode coupled to the power supply node 1 may be used. Similar effect can be obtained provided that the n channel MOS transistor has sufficiently large channel resistance.

[Modification 2]

Figure 5:
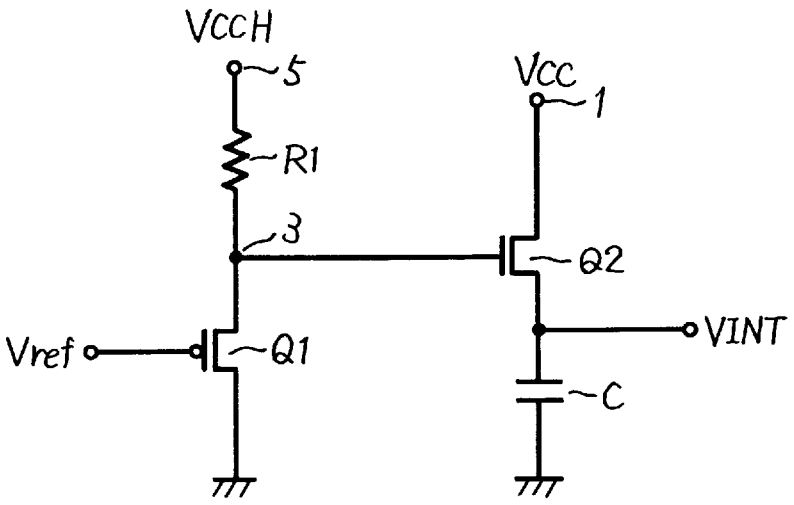
FIG. 5 shows a structure of a second modification of the first embodiment of the present invention.

FIG. 5 shows a structure of a second modification of the first embodiment of the present invention. In the second modification shown in FIG. 5, MOS transistor Q1 has its source (node 3) coupled to a boosted voltage node 5 to which high voltage VCCH is applied, through resistance element R1. Except this point, FIG. 6 structure is the same as the structure shown in FIG. 1, and corresponding portions are denoted by the same reference characters.

The high voltage VCCH is a voltage higher than the power supply voltage VCC. For example, in a semiconductor memory device, a boosted voltage Vpp is transmitted to a selected word line. Such a boosted voltage Vpp may be utilized as the high voltage VCCH. By utilizing a high voltage VCCH, the following advantages can be obtained.

To node 3, a voltage Vref+|VTP| is transmitted by the operation of the MOS transistor Q1 in the source follower mode. If the difference between reference voltage Vref and power supply voltage VCC is small, it may be necessary that the potential at node 3 is set higher than the power supply voltage VCC. In this case, current does not flow through resistance element R1, and hence, MOS transistor Q1 does not operate in the source follower mode but maintains the off state. Therefore, a voltage at a desired level cannot be generated at node 3. By connecting one end of resistance element R1 to boosted node 5 receiving the high voltage VCCH, it is possible to generate a voltage of a desired voltage level stably at node 3, even when power supply voltage VCC is close to the reference voltage Vref. Thus, a voltage of a desired level can be generated stably at node 3 over a wide range of supply voltage VCC, and accordingly, an internal voltage VINT of a desired level can be output.

In the structure shown in FIG. 5, similar effect can be obtained when resistance element R1 is replaced by an MOS transistor operated in a resistance mode as shown in FIG. 4. The high voltage VCCH applied to boosted node 5 may be externally applied, or alternatively, it may be applied from a circuit provided in the same device as described below.

Figure 6:
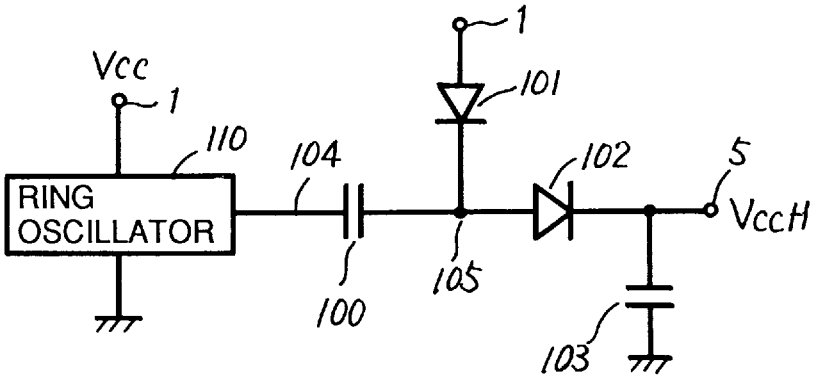
FIG. 6 shows an example of a structure of a high voltage generating circuit for generating the high voltage shown in FIG. 5.

FIG. 6 shows an example of a circuit structure for generating the high voltage VCCH in the semiconductor device. The high voltage generating circuit shown in FIG. 6 utilizes charge pump operation of a capacitor, and it is generally used for generating an high voltage higher than the power supply voltage.

Referring to FIG. 6, the high voltage generating circuit operates using the power supply voltage VCC at power supply node 1 and the ground potential Vss at the ground node as operational power supply voltages, and includes a ring oscillator 110 for generating a pulse signal having a prescribed pulse width and a period, a capacitor 100 connected between node 104 and node 105 for transmitting potential change at node 104 to node 105 by capacitive coupling, a diode element 101 connected between power supply node 1 and node 105, a diode element connected between node 105 and node 5, and a stabilizing capacitor 103 for stabilizing voltage at node 5.

Diode element 101 has its anode connected to power supply node 1, and its cathode connected to node 105. Diode element 102 has its anode connected to node 105, and its cathode connected to node 5. Ring oscillator 110 is constituted by odd number of stages of cascade connected inverter circuits. Diode elements 101 and 102 may be formed by MOS transistors. The operation will be briefly described.

When pulse signal output from ring oscillator 110 to node 104 lowers from the high level to the low level, the potential change in the signal at node 104 is transmitted through capacitor 100 to node 105.

Node 105 has its potential lowered because of capacitive coupling (charge pump operation) of capacitor 100. However, it is rapidly charged by diode element 101 and charged to the voltage level of VCC−Vf. Here, Vf represents forward voltage drop of diode elements 101 and 102. Hence the voltage VCCH of node 5 is higher than the voltage at node 105 at this time, diode element 102 is off.

When the pulse signal transmitted from ring oscillator 110 to node 104 rises from the low level to the high level by the capacitive coupling (charge pump operation) of capacitor 100 as the potential at node 104 increases, the potential at node 105 further increases by the voltage VCC (the amplitude of the pulse signal from ring oscillator 110 is VCC). As the voltage at node 105 increases, diode element 102 turns on, current flows from node 105 to node 5 (one electrode node of capacitor 103), and the voltage level at node 5 increases in accordance with the ratio (generally from 10 to 100) of capacitance of capacitor 100 to stabilizing capacitor 103. When the voltage difference between node 105 and node 5 attains to Vf, diode element 102 turns off. By repeating this operation, finally, the high voltage VCCH at node 5 attains to the voltage level represented by the following equation.

$$VCCH=2\cdot VCC-2\cdot Vf$$

When it is assumed that VCC=5 V and Vf=0.7 V, the high voltage VCCH would be 8.6 V, which is sufficiently higher voltage level than power supply voltage VCC. The current flowing through resistance R1 connected to the boosted node 5 to which high voltage VCCH is applied is made quite small (in order to realize operation of the MOS transistor Q1 in the source follower mode). Therefore, a very small current drivability is sufficient for the high voltage generating circuit shown in FIG. 6, and hence the area occupied by the high voltage generating circuit can be made sufficiently small. As the high voltage generating circuit, a boosting circuit used for generating a word line boosted signal or the like in a dynamic semiconductor memory device as described previously may be used. In other words, if a circuit for generating a high voltage internally is provided in the semiconductor device, that circuit may be utilized.

As described above, according to the first embodiment of the present invention, from a reference voltage Vref, a second reference voltage is generated by using a p channel MOS transistor operating in the source follower mode and the generated second reference voltage is applied to the gate of the output MOS transistor Q2 for generating internal voltage, and the output MOS transistor Q2 operates in the source follower mode to generate the internal voltage VINT of the desired voltage level, whereby comparing circuit for comparing the internal voltage and reference voltage becomes unnecessary and an internal voltage generating circuit with low current consumption can be obtained.

[Second Embodiment]

Figure 7:
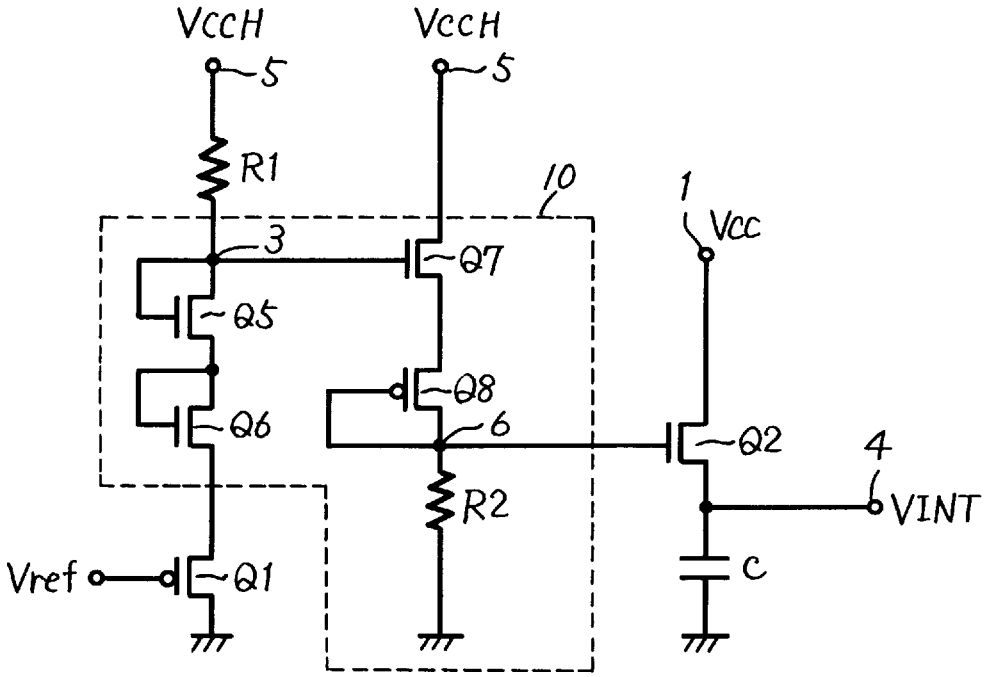
FIG. 7 shows a structure of an internal power supply circuit in accordance with a second embodiment of the present invention.

FIG. 7 shows a structure of an internal power supply circuit in accordance with the second embodiment of the present invention. Referring to FIG. 7, the internal power supply circuit includes an internal reference voltage generating circuit 10 for generating a second internal reference voltage from the output (source) voltage of MOS transistor Q1 operating in the source follower mode and for applying thus generated second internal reference voltage to the gate of the output MOS transistor Q2. The internal power supply voltage generating circuit 10 includes n channel MOS transistors Q5 and Q6 each being diode connected (operating in diode mode) and connected in series between resistance element R1 and MOS transistor Q1; an n channel MOS transistor Q7 receiving at its gate the voltage at node 3 and having its drain coupled to the boosted node 5; a diode connected (operating in diode mode) p channel MOS transistor Q8 connected between the source of MOS transistor Q7 and node 6 (gate of output MOS transistor Q2); and a resistance element R2 having high resistance and connected between node 6 and the ground node. Resistance element R1 is connected to boosted node 5.

MOS transistors Q5 and Q6 have their conduction resistances (channel resistances) made sufficiently smaller than the resistance value of resistance element R1. Similarly, conduction resistances (channel resistances) of MOS transistors Q7 and Q8 are made sufficiently smaller than the resistance value of resistance element R2. Consequently, MOS transistors Q6 and Q8 operate in the diode mode, and MOS transistor Q7 operates in a source follower mode (gate-source voltage of MOS transistor Q7 becomes equal to the threshold voltage of MOS transistor Q7). The internal reference voltage generating circuit 10 cancels the effect (influence) of the threshold voltages of MOS transistors Q1 and Q2 on the internal voltage VINT produced by the output MOS transistor Q2.

The source potential of MOS transistor Q1 is Vref+|VTP|. Since MOS transistors Q5 and Q6 operate in the diode mode, the voltage V3 at node 3 can be given by the following equation (6).

$$V3=Vref+|VTP|+2\cdot VTN \tag{6}$$

The reference character VTN represents the threshold voltage of MOS transistors Q5 and Q6. In the following description, it is assumed that the n channel MOS transistors all have the same threshold voltage VTN, and the p channel MOS transistors have the same threshold voltage VTP. Since the voltage at node 3 is lower than the voltage level of boosted node 5, MOS transistor Q7 transmits a voltage which is lower than the gate voltage by the threshold voltage VTN. MOS transistor Q8 operates in the diode mode, and causes a voltage drop of |VTP|. Therefore, the voltage V6 at node 6 is given by the following equation (7).

$$\begin{aligned} V6 &= V3 - VTN - |VTP| \\ &= Vref + |VTP| + 2\cdot VTN - |VTP| \\ &= Vref + VTN \end{aligned} \tag{7}$$

The voltage VINT appearing at output node 4 is given by the following equation (8).

$$\begin{aligned} VINT &= V6 - VTN \\ &= Vref \end{aligned} \tag{8}$$

The equation (8) does not include the terms of the threshold voltages VTP and VTN of the MOS transistors. Therefore, the internal voltage VINT transmitted to the output node has an voltage level which is determined only by the reference voltage Vref, it is not influenced by the threshold voltages of the MOS transistors which may deviated because of variation in manufacturing parameters, and it maintains a constant voltage level. Therefore, internal voltage of a prescribed voltage level can be generated accurately. Further, since the internal voltage VINT is determined only by the reference voltage Vref, it is not necessary to consider operational parameters of the components included in the internal reference voltage generating circuit 10, it is not necessary to consider the layout of the components either, and hence design is facilitated.

Further, since the voltage level of internal voltage VINT is determined only by the difference voltage Vref, it is not necessary to optimize the threshold voltages of the MOS transistors included in the internal reference voltage generating circuit 10, and hence manufacturing is facilitated.

Further, since current is supplied from boosted node 5 to internal reference voltage generating circuit 10, the internal reference voltage generating circuit 10 can operate stably even when the reference between the power supply voltage VCC and the reference voltage Vref is small, whereby internal voltage VINT having a desired voltage level can be generated stably over a wide voltage range of power supply voltage VCC.

In the structure shown in FIG. 7, MOS transistor operating in a resistance mode may be used in place of resistance elements R1 and R2. The power supply voltage VCC may be applied to the boosted node 5. However, in that case, it is necessary to set the power supply voltage VCC higher than the reference voltage Vref by at least 2·VTN.

As described above, according to the second embodiment of the present invention, from an output (source) voltage of an MOS transistor Q1 operating in the source follower mode and receiving at its gate the first reference voltage Vref, a second internal reference voltage is generated by the internal reference voltage generating circuit and thus generated second internal reference voltage is applied to the gate of the output MOS transistor Q2. Therefore, as in the first embodiment, the output MOS transistor operates in the source follower mode to generate the internal voltage VINT, so that comparing circuit for comparing the internal voltage with the reference voltage becomes unnecessary, and power consumption can be reduced. Further, since the internal reference voltage generating circuit has a function of canceling the influence of threshold voltages of MOS transistors Q1 and Q2 on the internal voltage VINT, the internal voltage VINT becomes equal to the first reference voltage Vref and hence an internal voltage of a desired voltage level can be surely and stably generated even when there is variation in manufacturing parameters.

[Third Embodiment]

Figure 8:
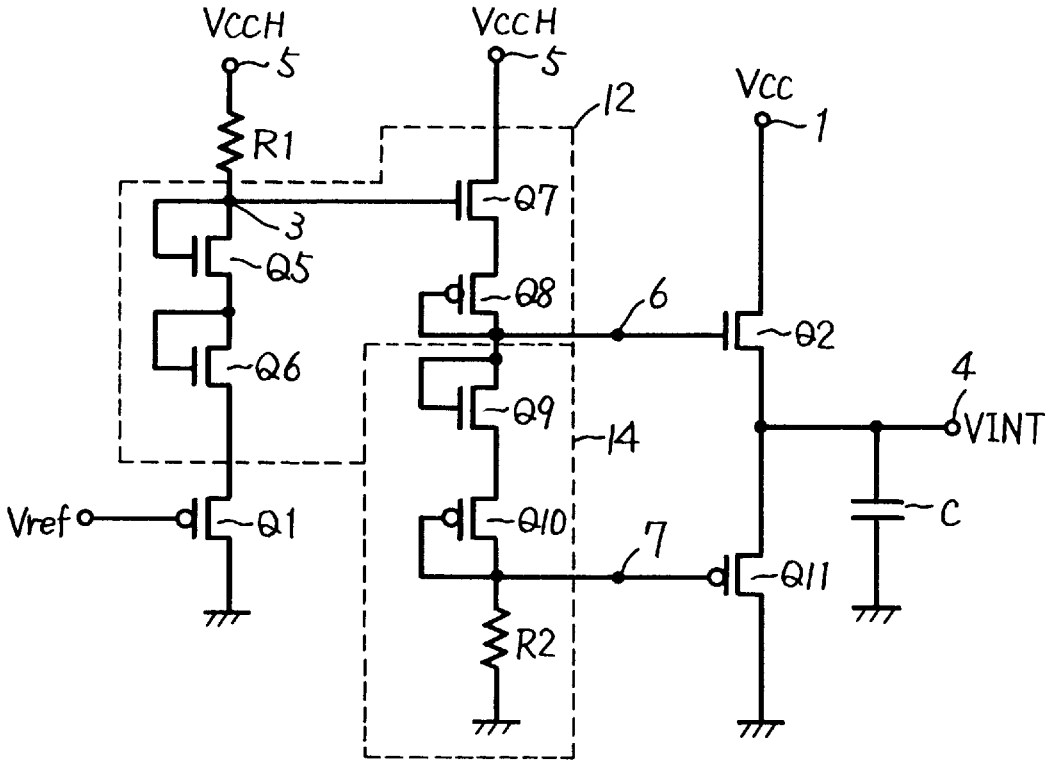
FIG. 8 shows a structure of an internal power supply circuit in accordance with a third embodiment of the present invention.

FIG. 8 shows a structure of an internal power supply circuit in accordance with a third embodiment of the present invention. Referring to FIG. 8, the internal power supply circuit includes a p channel MOS transistor Q1 receiving at its gate a first reference voltage Vref and operating in the source follower mode; a first internal voltage generating circuit 12 for generating a second reference voltage from the voltage generated by the MOS transistor Q1 and for applying thus generated second reference voltage to the gate of an output MOS transistor Q2, a second internal voltage generating circuit 14 for generating a third reference voltage from the second reference voltage on node 6 output from the first internal voltage generating circuit 12 and transmitting the same to a node 7; and a p channel MOS transistor Q11 connected between the output node 4 and the ground node and receiving at its gate the third reference voltage on node 7.

The first internal voltage generating circuit 12 has similar structure as the internal reference voltage generating circuit 10 shown in FIG. 7, and corresponding components are denoted by the same reference characters.

The second internal voltage generating circuit 14 includes n channel MOS transistor Q9 and a p channel MOS transistor Q10 each being diode connected and connected in series between nodes 6 and 7. A resistance element R2 having high resistance is connected between node 7 and the ground node. Conduction resistances of MOS transistors Q9 and Q10 are set to a value sufficiently smaller than the resistance value of resistance element R2. The operation will be described. The voltage V6 at node 6 is given by $$V6=Vref+VTN$$

as in the second embodiment above. Because of the resistance element R2 having high resistance, only a small current flows through MOS transistors Q9 and Q10, which transistors operate in the diode mode, and cause a voltage drops of |VTP| and VTN. Therefore, the voltage V7 at node 7 is given by $$V7 = Vref + VTN - VTN - |VTP| = Vref - |VTP|.$$

When the internal voltage VINT output node 4 increases to be higher than the reference voltage Vref, p channel MOS transistor (second output transistor) Q11 is rendered conductive, thus lowering the voltage level of internal voltage VINT. When the internal voltage VINT becomes lower than the reference voltage Vref, MOS transistor Q11 is turned off. In this state, the gate-source voltage of MOS transistor Q2 becomes higher than the threshold voltage VTN, and MOS transistor Q2 is rendered conductive and supplies current from power supply node 1 to output node 4, so that the voltage level of the internal voltage VINT is increased.

Provision of the MOS transistor Q11 for discharging the output node 4 provides the following advantages. When a DC-wise coupling (coupling providing a current flowing path) is generated by some cause between a line connected to the output node 4 and a line transmitting voltage higher than the internal voltage VINT, and the voltage level of internal voltage VINT increases, then MOS transistor Q11 is rendered conductive and lowers the increased internal voltage VINT to the prescribed voltage level.

A capacitance C for stabilization is provided at output node 4, and ringing or the like of internal voltage VINT at output node 4 is smoothed. However, when an internal circuit or the like, not shown, operates and consumes large current abruptly to lower the voltage level of internal voltage VINT, a large load current flows through MOS transistor Q2. If the voltage level of internal voltage VINT rises abruptly because of the large load current IL compensating for the current consumption, there may be caused ringing in the internal voltage VINT at output node 4. Therefore, in such a case, MOS transistor Q11 is rendered conductive to stop such ringing, and thus the voltage level of internal voltage VINT can be maintained stably at a desired voltage level. MOS transistors Q2 and Q11 have current drivability large enough to supply the current consumed by the internal current. Therefore, even when the voltage level of internal voltage VINT on output node 4 changes, the internal voltage VINT can be returned to a desired voltage level (Vref) rapidly.

In the structure shown in FIG. 8, the order of connection of MOS transistors Q9 and Q10 between nodes 6 and 7 may be switched provided that the voltage difference between nodes 6 and 7 is VTN+|VTP|.

It goes without saying that the MOS transistors Q9 and Q10 have functions of canceling the influence of threshold voltages of MOS transistors Q11 and Q1 on the high level side potential at output node 4 which is clamped by MOS transistor Q11.

[Modification]

Figure 9:
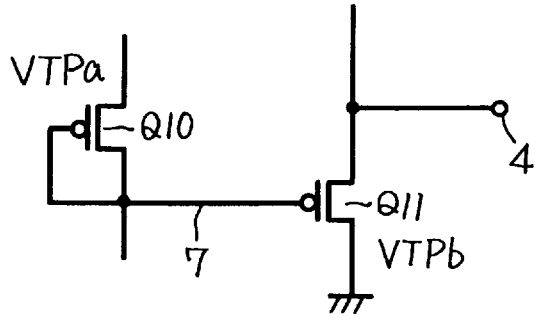
FIG. 9 shows a structure of a main portion of a modification of the third embodiment in accordance with the present invention.

FIG. 9 shows a modification of the third embodiment of the present invention. FIG. 9 shows only the p channel MOS transistors Q10 and Q11 of the internal power supply circuit shown in FIG. 8. In the structure of the internal power supply circuit shown in FIG. 9, the absolute value of the threshold voltage VTPb of MOS transistor Q11 is made smaller than the absolute value of the threshold voltage VTPa of MOS transistor Q10. MOS transistor Q11 is rendered conductive when the following relation is satisfied.

VINT>Vref−|VTPa|+|VTPb|>Vref

Therefore, when the internal voltage VINT is at the voltage level of the reference voltage Vref, MOS transistor Q11 is off. If the internal voltage VINT lowers slightly than the reference voltage Vref, MOS transistor Q2, which is not shown, is rendered conductive. Even when internal voltage VINT rises slightly from the reference voltage Vref, MOS transistor Q11 is not rendered conductive. At this time, MOS transistor Q2 turns off. When MOS transistor Q11 is rendered conductive, MOS transistor Q2 is off. Therefore, it can be prevented that both MOS transistors Q2 and Q11 are rendered conductive simultaneously. Since MOS transistors Q2 and Q11 supply operational current to the internal circuitry, they have large current drivability. If the internal voltage VINT is at the reference voltage Vref and MOS transistors Q2 and Q11 operate in the boundary region between on and off states, a relatively large through current may possibly flow from the power supply node 1 to the ground node. Therefore, by keeping off at least one of the MOS transistors Q2 and Q11 as described above, through current flowing from the power supply node 1 to the ground node can be prevented, and an internal power supply circuit with low current consumption can be implemented.

Figure 10:
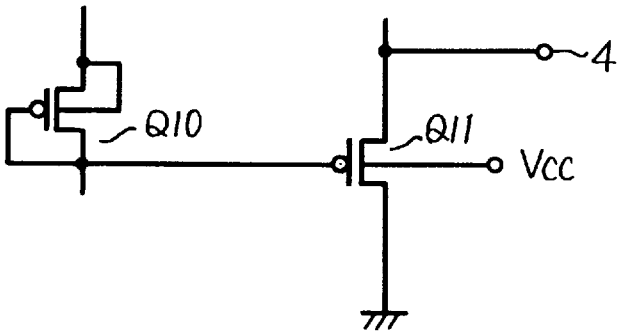
FIG. 10 shows a specific example of the structure in FIG. 9.

FIG. 10 shows a structure for adjusting threshold voltages of MOS transistors Q10 and Q11 of FIG. 9. As shown in FIG. 10, MOS transistor Q10 has its back gate (substrate region) connected to the source of itself. MOS transistor Q11 has its back gate (substrate region) connected to receive the power supply voltage VCC. MOS transistor Q10 has its substrate region and its source connected to each other, and therefore back gate effect is not generated. Meanwhile, MOS transistor Q11 receives the power supply voltage VCC at its back gate, so that the back gate effect is generated, and the absolute value of the threshold voltage VTPb becomes larger than the absolute value of the threshold voltage of MOS transistor Q10. Consequently, it is possible to render MOS transistor Q11 conductive when the internal voltage VINT increases above the threshold value or more from the reference voltage Vref. The voltage applied to the back gate of MOS transistor Q11 may be any voltage higher than the voltage VINT on output node 4, or the source voltage, and hence it may be the high voltage VCCH.

As an alternative method of adjusting threshold voltages of MOS transistors Q10 and Q11, the absolute value of the threshold voltage of MOS transistor Q11 may be enlarged by implanting N type impurity ion such as arsenic to the channel region of the MOS transistor Q11.

As described above, according to the third embodiment of the present invention, a p channel MOS transistor for discharging is provided between the output node and the ground node, the second internal reference voltage is generated from the first internal reference voltage and the generated second internal reference voltage is applied to the gate of the output MOS transistor for discharging. Therefore, even when the voltage level of the internal voltage VINT increases, the voltage level of the internal voltage VINT can be immediately returned to the desired voltage level and hence an internal power supply circuit which surely maintains the desired voltage level can be implemented. Further, similar effect as in the first and second embodiments can be obtained.

[Fourth Embodiment]

Figure 11:
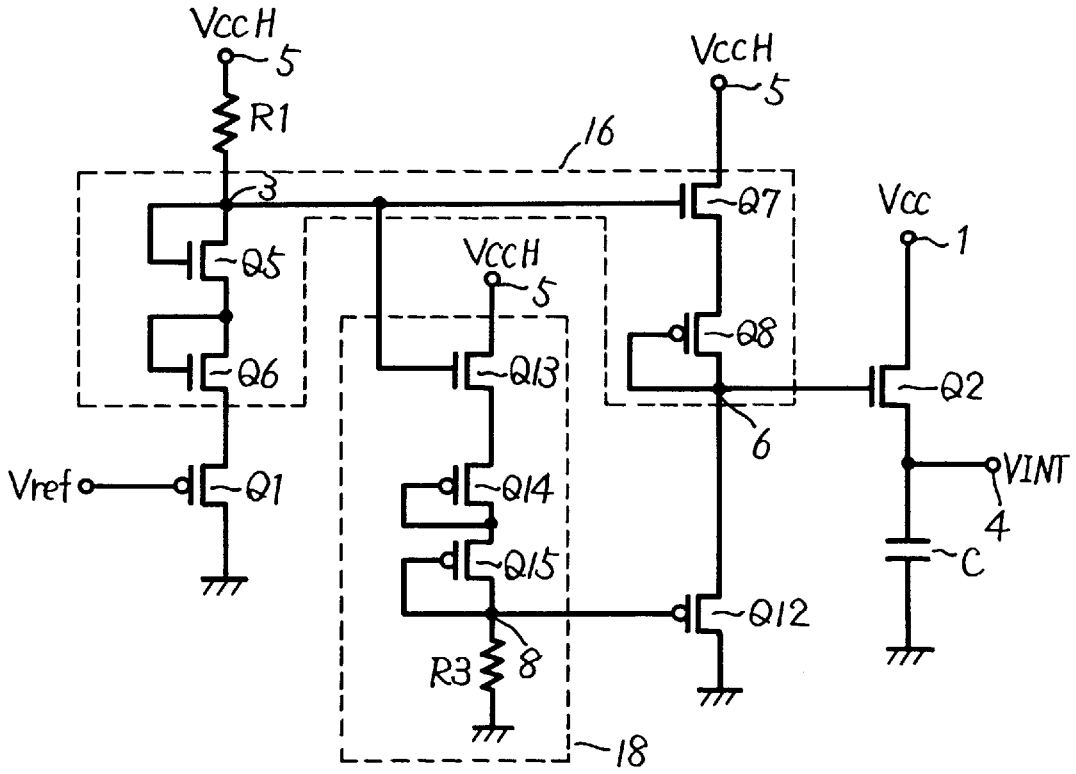
FIG. 11 shows a structure of an internal power supply circuit in accordance with a fourth embodiment of the present invention.

FIG. 11 shows a structure of an internal power supply circuit in accordance with the fourth embodiment of the present invention. Referring to FIG. 11, the internal power supply circuit includes p channel MOS transistor Q1 receiving at its gate the reference voltage Vref and operating in the source follower mode; an internal voltage generating circuit 16 for generating a second internal reference voltage from the source potential of MOS transistor Q1; an internal voltage generating circuit 18 for generating a third reference voltage from the internal voltage generated by MOS transistor Q1; and a p channel MOS transistor Q12 for discharging a potential at node 6 in accordance with the output voltage from internal voltage generating circuit 18. Internal voltage generating circuit 16 substantially has the same structure as that shown in FIG. 8, and corresponding portions are denoted by the same reference characters and detailed description thereof is not repeated.

Internal voltage generating circuit 18 includes an n channel MOS transistor Q13 receiving at its gate the internal voltage at node 3 and operating in the source follower mode; p channel MOS transistors Q14 and Q15 connected in series between MOS transistor Q13 and node 8 and each operating in the diode mode; and resistance element R3 having high resistance connected between node 8 and the ground node. The resistance value of the resistance element R3 is made sufficiently larger than the conduction resistance (channel resistance) of MOS transistors Q13 to Q15. MOS transistor Q13 has its drain connected to the boosted node 5. In this structure, if MOS transistor Q8 is to be operated in the diode mode, what is necessary is that the current drivability of MOS transistor Q8 is set sufficiently larger than the current drivability of MOS transistor Q7. The operation will be described.

The voltage V6 at node 6 is Vref+VTN as in the third embodiment shown in FIG. 8. In this state, the output MOS transistor Q2 operates in the similar manner as in the second embodiment.

The voltage V8 at node 8 is given by the following equation from the voltage V3 on node 3.

$$\begin{aligned} V8 &= V3 - VTN - 2 \cdot |VTP| \\ &= Vref + VTN - |VTP| \end{aligned} \tag{9}$$

The difference between the voltage V6 on node 6 and the voltage V8 on node 8 is given by the following equation.

V6−V8=|VTP|

Therefore, MOS transistor Q12 operates at the boundary between the on and off states, as the source-gate potential difference is equal to the threshold voltage of itself. When the voltage V6 on node 6 increases by the influence of noise, for example, MOS transistor Q12 is rendered conductive, and voltage V6 on node 6 lowers. When the voltage V6 on node 6 lowers, MOS transistor Q12 is rendered conductive while the potential thereof is increased by MOS transistor Q8. Therefore, by the provision of MOS transistor Q12 and the second internal voltage generating circuit 18, when the voltage at node increases by the noise, the voltage at node 6 can be quickly lowered to the prescribed voltage level. Accordingly, gate voltage of the output MOS transistor Q2 can be maintained at a constant level, and accordingly, the internal voltage VINT can be maintained at the voltage level of the reference voltage Vref. When the voltage V6 on node 6 increases, the source-gate potential of output MOS transistor Q2 increases accordingly, current flows from the power supply node 1 to the output node 4 and the voltage level of internal voltage VINT increases.

As described above, in accordance with the fourth embodiment of the present invention, when the gate potential of the output MOS transistor increase, the potential is adapted to be lowered by the MOS transistor Q12 immediately, so that the gate potential of the output MOS transistor can be maintained stably at a prescribed voltage level, and accordingly, the voltage level of the internal voltage VINT can be maintained accurately at the desired voltage level.

[Fifth Embodiment]

Figure 12:
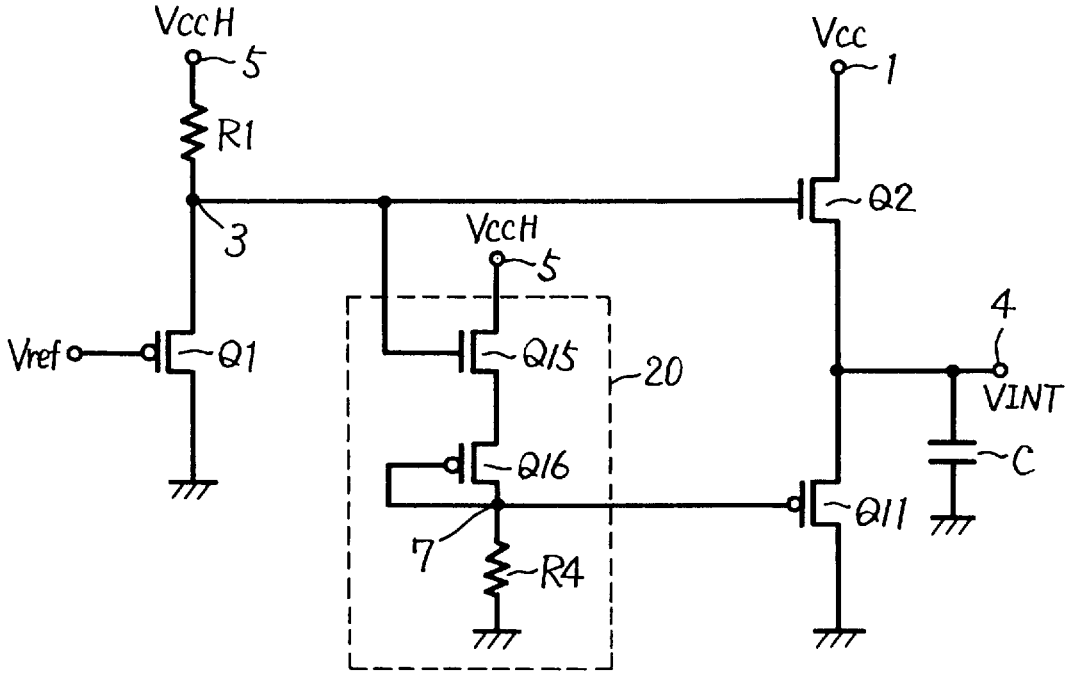
FIG. 12 shows a structure of an internal power supply circuit in accordance with a fifth embodiment of the present invention.

FIG. 12 shows a structure of an internal power supply circuit in accordance with the fifth embodiment of the present invention. Referring to FIG. 12, the internal power supply circuit includes, in addition to the structure shown in FIG. 5, a p channel MOS transistor Q11 as a second output MOS transistor discharging the output node 4, and an internal voltage generating circuit 20 for generating a third internal reference voltage from the voltage on node 3 for transmission the same to the gate of MOS transistor Q11. Internal voltage generating circuit 20 includes an n channel MOS transistor Q15 receiving at its gate the voltage on node 3 and transmitting the voltage on node 3 in the source follower mode; a p channel MOS transistor Q16 operating in the diode mode, for lowering the voltage transmitted from MOS transistor Q15 for transmission to node 7; and a resistance element R4 connected between the node 7 and the ground node. The node 7 is connected to the gate of MOS transistor Q11. Resistance value of resistance element R4 is made sufficiently larger than the conduction resistance (channel resistance) of each of MOS transistors Q15 and Q16. Therefore, MOS transistor Q16 operates in the diode mode, and MOS transistor Q15 operates in the source follower mode. The drain of MOS transistor Q15 is connected to the boosted node 5. The operation will now be described. The voltage V3 on node 3 is given by Vref+|VTP|. Therefore, the voltage V7 on node 7 is given by $$\begin{aligned} V7 &= Vref + |VTP| - VTN - |VTP| \\ &= Vref - VTN. \end{aligned}$$

MOS transistor Q2 operates in the source follower mode, and clamps the lower voltage level of the internal voltage VINT at output node 4 to Vref+|VTP|−VTN.

Meanwhile, MOS transistor Q11 similarly operates in the source follower mode, and clamps the higher voltage level of the internal voltage VINT on node 4 at Vref−VTN+|VTP|. Namely, the internal voltage VINT can be represented by VINT=Vref+|VTP|−VTN.

When the voltage level of internal voltage VINT increases, MOS transistor Q2 is rendered conductive, and supplies current from power supply node 1 to output node 4. Meanwhile, if internal voltage VINT increases, MOS transistor Q11 is rendered conductive, discharges the output node 4, and lowers the voltage level of internal voltage VINT. Consequently, even when the voltage level of internal voltage VINT increases, it can be surely returned to the desired voltage level. Here, the current supplying capabilities of MOS transistors Q2 and Q11 are made sufficiently large, and even when the internal voltage VINT fluctuates because of abrupt change in current consumed by the internal circuitry, the fluctuation can be absorbed by the large current drivabilities of MOS transistors Q2 and Q11, whereby internal voltage VINT of a stable level is ensured.

As described above, according to the fifth embodiment of the present invention, since the second output MOS transistor Q11 is adapted to be rendered conductive or non-conductive in accordance with the difference between the voltage at the internal output node 4 and the third reference voltage from internal voltage generating circuit 20, even when the internal voltage VINT increases, the internal voltage can be returned to the prescribed voltage level immediately.

[Sixth Embodiment]

Figure 13:
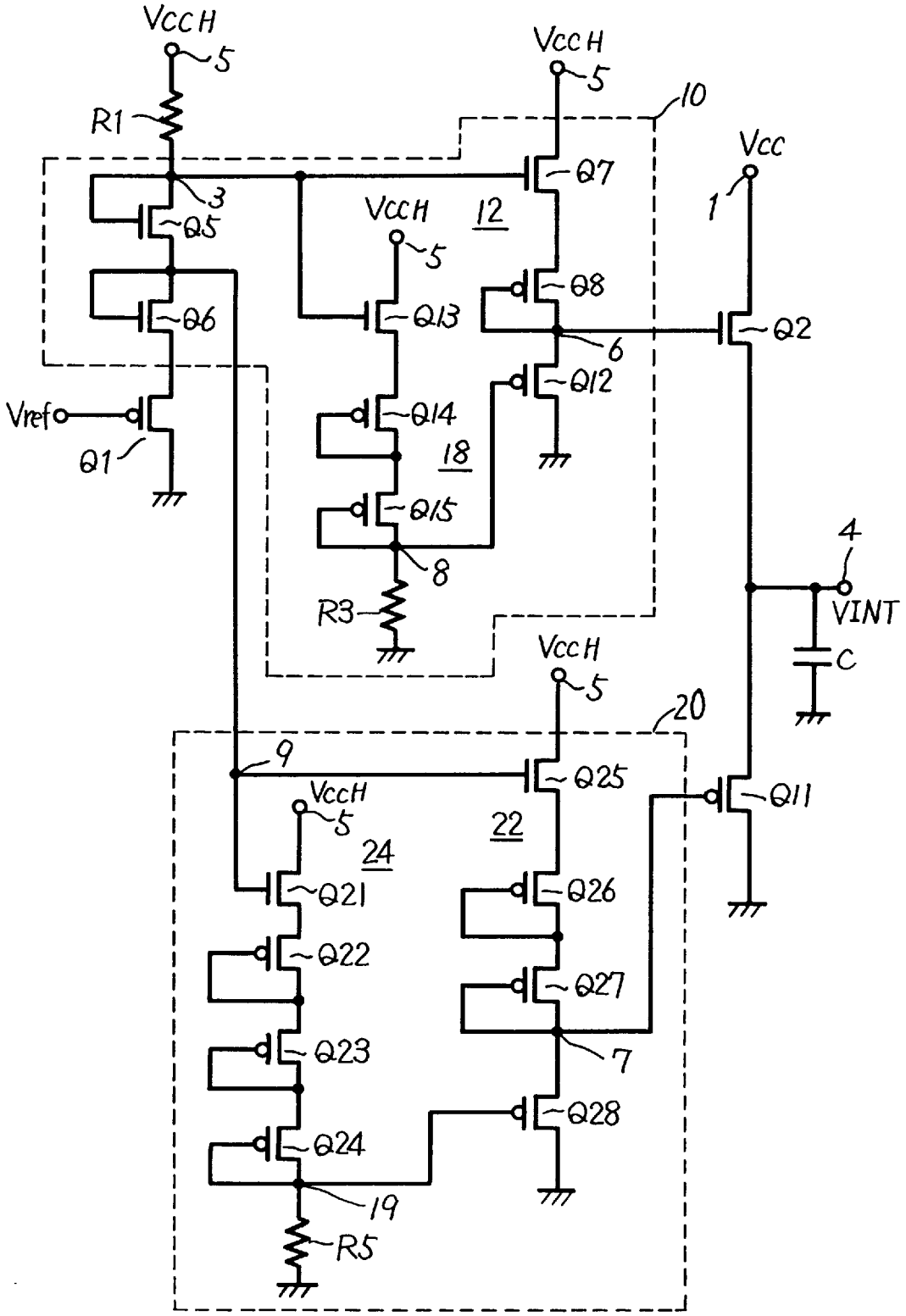
FIG. 13 shows a structure of an internal power supply circuit in accordance with a sixth embodiment of the present invention.

FIG. 13 shows a structure of an internal power supply circuit in accordance with the sixth embodiment. Referring to FIG. 13, the internal power supply circuit includes a p channel MOS transistor Q1 receiving at its gate the reference voltage Vref and operating in the source follower mode; a first internal reference voltage generating circuit 10 for generating a second reference voltage from the voltage generated by the MOS transistor Q1; an output MOS transistor Q2 connected between the power supply node 1 and output node 4 and receiving at its gate the reference voltage from the first internal voltage generating circuit 10; a second internal reference voltage generating circuit 20 for generating a third reference voltage from the voltage generated by the MOS transistor Q1; and a p channel MOS transistor (second output MOS transistor) Q11 connected between output node 4 and ground node and receiving at its gate the third reference voltage generated by the second internal voltage generating circuit 20. A capacitor C for stabilization is connected to output node 4.

The first internal reference voltage generating circuit 10 includes an internal voltage generating circuit 12 for generating a first reference voltage from the voltage generated by the MOS transistor Q1; a p channel MOS transistor Q12 for suppressing increase in the potential at node 6 (gate of output MOS transistors Q2); and a second internal voltage generating circuit 18 generating a reference voltage for controlling conduction/non-conduction of MOS transistor Q12. The first internal voltage generating circuit 12 includes n channel MOS transistors Q5 and Q6 connected in series between node 3 and MOS transistor Q1 and each operating in the diode mode; an n channel MOS transistor Q7 transmitting the voltage on node 3 in the source follower mode; and a p channel MOS transistor Q8 operating in the diode mode for further lowering the voltage applied from MOS transistor Q7. The gate and drain of MOS transistor Q8 are connected to node 6. The drain of MOS transistor Q7 is connected to boosted node 5.

The second internal voltage generating circuit 18 includes an n channel MOS transistor Q13 transmitting the voltage on node 3 in the source follower mode; p channel MOS transistors Q14 and Q15 for lowering the voltage from MOS transistor Q13, connected in series and each operating in the diode mode; and a resistance element R3 having a high resistance connected between node 8 and the ground node. Node 8 is connected to the gate of MOS transistor Q12.

The structure and operation of the first internal reference voltage generating circuit 10 are the same as the first and second internal voltage generating circuits 16 and 18 shown in FIG. 11. The second reference voltage Vref+VTN on node 6 has its fluctuation suppressed, and is maintained at a constant level.

The second internal reference voltage generating circuit 20 includes a third internal voltage generating circuit 22 for generating a third reference voltage from the voltage transmitted by the MOS transistor Q6 included in the first internal reference voltage generating circuit 10 to the node 9; a p channel MOS transistor Q28 for suppressing increase of the voltage level of the third reference voltage (voltage on node 7); and a fourth internal voltage generating circuit 24 for generating a voltage for controlling conduction/non-conduction of MOS transistor Q28.

The third internal voltage generating circuit 22 includes an n channel MOS transistor Q25 for transmitting the voltage on node 9 in the source follower mode; and p channel MOS transistors Q26 and Q27 connected in series between MOS transistor Q25 and node 7 and each operating in the diode mode. The third internal voltage generating circuit 22 has the function of canceling the influence of threshold voltages of MOS transistors Q11, Q1 and Q6 on the voltage transmitted by MOS transistor Q11 in the source follower mode to output node 4.

The fourth internal voltage generating circuit 24 includes an n channel MOS transistor Q21 transmitting the voltage on node 9 in the source follower mode; p channel MOS transistors Q22, Q23 and Q24 connected in series with each other between MOS transistor Q21 and node 19 and each operating in the diode mode; and a resistance element R5 having a high resistance and connected between node 19 and the ground node. The resistance value of resistance element R5 is set to a value sufficiently larger than conduction resistances (channel resistances) of MOS transistors Q21 to Q24. The operation will now be described.

The operation of the first internal reference voltage generating circuit 10 is the same as that shown in FIG. 11 and therefore detailed description thereof is not repeated. Only the operation of the second internal reference voltage generating circuit 20 will be described.

To the node 9, a voltage V9 represented by the following equation is applied.

V9=Vref+|VTP|+VTN

MOS transistor Q21 has its drain connected to the boosted node and operates in the source follower mode. MOS transistors Q22 to Q24 operate in the diode mode. Therefore, MOS transistors Q21 to Q24 transmit the voltage lowered by the threshold voltages respectively. Therefore, the voltage V19 on node 19 can be given by $$\begin{aligned} V19 &= V9 - VTN - 3\,|VTP| \\ &= Vref - 2\,|VTP|. \end{aligned}$$

Meanwhile, MOS transistor Q25 has its drain connected to the boosted node 5 and operates in the source follower mode, while MOS transistors Q26 and Q27 operate in the diode mode. Therefore, the voltage V7 on node 7 can be given by the following equation.

$$\begin{aligned} V7 &= V9 - VTN - 2\,|VTP| \\ &= Vref - |VTP| \end{aligned}$$

When the voltage V7 on node 7 becomes higher than Vref−|VTP|, the source-gate potential of MOS transistor Q28 becomes larger than IVTPI, MOS transistor Q28 is rendered conductive, and lowers the voltage V7 of node 7. Therefore, the voltage V7 on node 7 is kept at a constant voltage level.

MOS transistor Q11 transmits the voltage of V7+|VTP|= Vref, in accordance with the voltage level of voltage V7 on node 7. Therefore, the internal voltage VINT on output node 4 is kept at the voltage level of reference voltage Vref. If the internal voltage VINT increases, MOS transistor Q11 is rendered conductive and lowers the internal voltage VINT to the prescribed voltage level. When the internal voltage VINT lowers, MOS transistor Q2 is rendered conductive, and returns the internal voltage VINT to the prescribed voltage level.

As described above, in accordance with the sixth embodiment of the present invention, the output charging MOS transistor Q2 operating in the source follower mode and the output discharging MOS transistor Q1 are provided for output node 4 and constant reference voltage is applied to the gates of these transistors. Therefore, an internal voltage VINT having a desired voltage level can be generated with low current consumption. Further, since a circuit for suppressing increase in gate potential of output MOS transistors Q2 and Q11 is provided, the gate voltages of the output MOS transistors can be prevented from being too high, and an internal voltage of a desired voltage level can be accurately generated.

[Seventh Embodiment]

Figure 14:
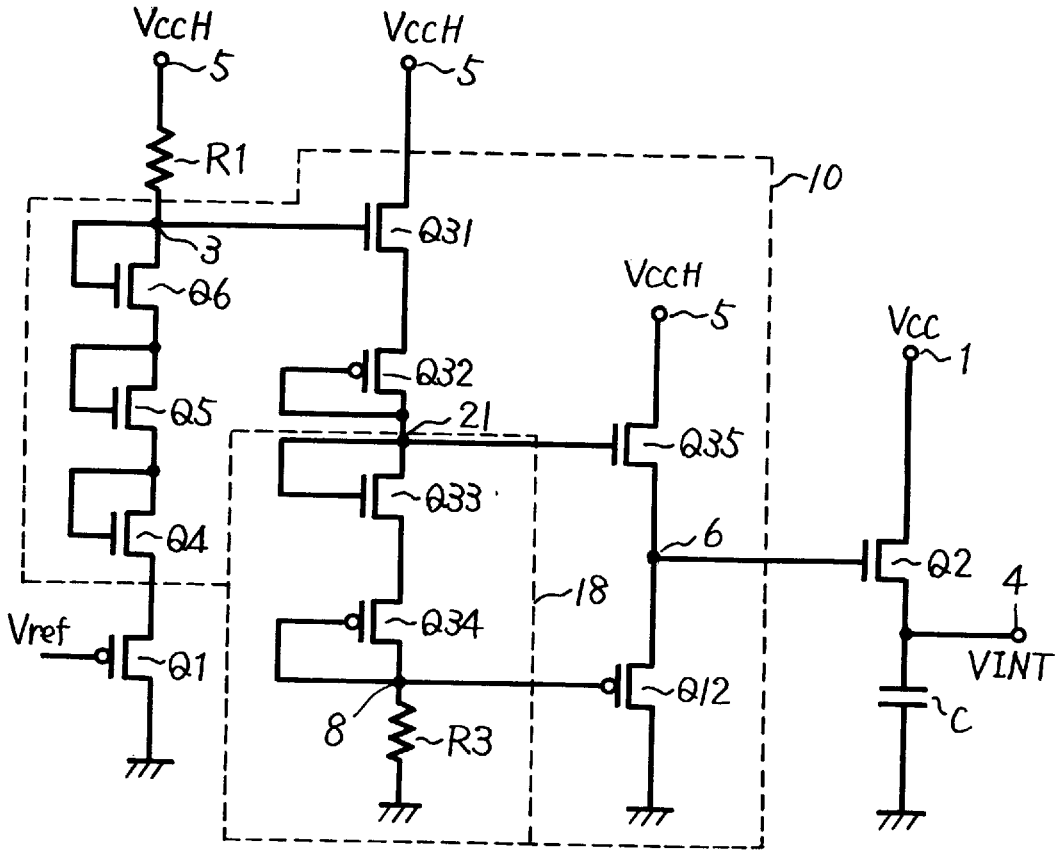
FIG. 14 shows a structure of an internal power supply circuit in accordance with a seventh embodiment of the present invention.

FIG. 14 shows a structure of an internal power supply circuit in accordance with the seventh embodiment of the present invention. Referring to FIG. 14, the internal power supply circuit includes a p channel MOS transistor Q1 receiving the reference voltage Vref at its gate and transmitting the reference voltage Vref in the source follower mode; an internal reference voltage generating circuit 10 for generating a second reference voltage from the internal voltage generated by the MOS transistor Q1; and an n channel MOS transistor Q2 coupled between the power supply node 1 and the output node 4, receiving at its gate the second internal reference voltage from the first internal reference voltage generating circuit 10 and transmitting the second internal reference voltage to the output node 4 in the source follower mode.

The first internal reference voltage generating circuit 10 includes n channel MOS transistors Q4 to Q6 connected in series between node 3 and MOS transistor Q1 and each operating in the diode mode; an n channel MOS transistor Q31 receiving at its gate the voltage on node 3 and operating in the source follower mode; a p channel MOS transistor Q32 operating in the diode mode and lowering the voltage received from MOS transistor Q31; and an n channel MOS transistor Q35 receiving at its gate the voltage transmitted to the node 21 from MOS transistor Q32, transmitting the received voltage to node 6 in the source follower mode for generating a second reference voltage. Drains of MOS transistors Q31 and Q35 are connected to boosted node 5. Node 3 is connected through resistance element R1 to boosted node 5.

The internal reference voltage generating circuit 10 further includes a p channel MOS transistor Q12 coupled between node 6 and the ground node, and an internal voltage generating circuit 18 generating a third reference voltage controlling conduction/non-conduction of MOS transistor Q12. MOS transistor Q12 operates in the source follower mode.

Internal voltage generating circuit 18 includes n channel MOS transistors Q33 and Q34 connected in series between nodes 21 and 28 and each operating in the diode mode, and a resistance element R3 having a high resistance connected between node 8 and the ground node. The resistance value of resistance element R3 is set to be a value sufficiently larger than the conduction resistances (channel resistances) of MOS transistors Q31 to Q34. The operation will now be described.

MOS transistors Q4 to Q6 all operate in the diode mode (resistance value of resistance R1 is sufficiently large). Therefore, the voltage V3 on node 3 is given by the following equation.

$$V3=Vref+3\cdot VTN+|VTP|$$

MOS transistor Q31 operates in the source follower mode, and lowers the gate potential by threshold voltage VTN and transmits the lowered potential to the source thereof. MOS transistor Q32 operates in the diode mode. Therefore, the voltage V21 on node 21 can be given by the following equation.

$$\begin{aligned} V21 &= V3 - VTN - |VTP| \\ &= Vref + 2 \cdot VTN \end{aligned}$$

MOS transistor Q35 operates in the source follower mode, lowers the gate potential, that is, the voltage on node 21 by threshold voltage VTN and transmits the lowered voltage to the node 6. Therefore, the voltage V6 on node 6 can be given by the following equation.

$$\begin{aligned} V6 &= V21 - VTN \\ &= Vref + VTN \end{aligned}$$

Different from the structure shown in FIG. 13, the gate of output MOS transistor Q2 is connected to the boosted node through one stage of MOS transistor Q35. Therefore, when the power is turned on and the potential at boosted node 5 increases, the voltage on node 6 increases at high speed, and the internal voltage from output node 4 rises at high speed accordingly. Therefore, after the application of power, the internal voltage VINT reaches the prescribed voltage level immediately.

The MOS transistors Q33 and Q34 of internal voltage generating circuit 18 both operate in the diode mode. Therefore, the voltage V8 on node 8 can be given by the following equation.

$$\begin{aligned} V8 &= V21 - VTN - |VTP| \\ &= Vref + VTN - |VTP| \end{aligned}$$

MOS transistor Q12 operates in the source follower mode. Therefore, when the voltage V6 on node 6 increases to be higher than Vref+VTN, MOS transistor Q12 is rendered conductive to lower the voltage V6 on node 6 to a prescribed voltage level. Therefore, even when the voltage on node 6 increases because of noise or the like, the voltage on node 6 can be immediately returned to the prescribed voltage level, and accordingly, an internal voltage VINT of a stable level can be generated.

As described above, according to the seventh embodiment of the present invention, since the gate of output MOS transistor Q2 is coupled to the power supply node (boosted node) through one stage of MOS transistor Q35, the rise of the gate potential of the output MOS transistor at the time of power on can be realized at higher speed and hence the internal voltage VINT rises quickly accordingly.

[Eighth Embodiment]

Figure 15:
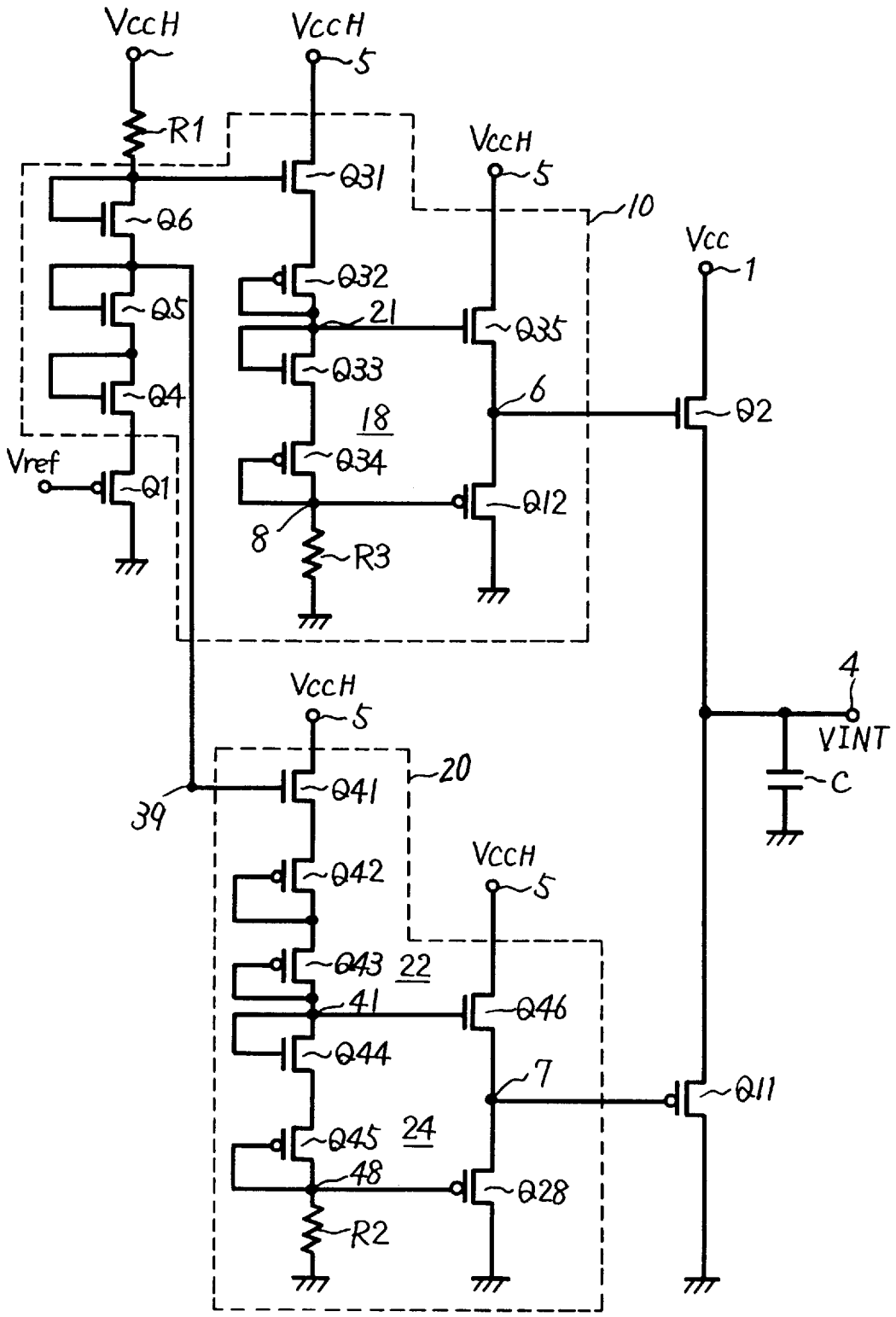
FIG. 15 shows a structure of an internal power supply circuit in accordance with an eighth embodiment of the present invention.

FIG. 15 shows a structure of an internal power supply circuit in accordance with the eighth embodiment of the present invention. In FIG. 15, the structures of output MOS transistor Q2 and the first internal reference voltage generating circuit setting the gate potential of output MOS transistor Q2 in accordance with the voltage generated by MOS transistor Q1 are the same as those shown in FIG. 14. Therefore, corresponding portions are denoted by the same reference characters and detailed description thereof is not repeated.

The internal power supply circuit further includes a second internal reference voltage generating circuit 20 for generating a third reference voltage from the voltage generated in accordance with the output voltage of MOS transistor Q1 which has been transmitted to node 39, and a p channel MOS transistor Q11 operating in source follower mode and receiving at its gate the output voltage from the second internal reference voltage generating circuit 20. MOS transistor Q11 is coupled between output node 4 and the ground node. To the node 39, the voltage generated by the MOS transistor Q5 included in the first internal reference voltage generating circuit 10 (drain voltage of MOS transistor Q5) is transmitted.

The second internal reference voltage generating circuit 20 includes an internal voltage generating circuit 22 for generating a third reference voltage to node 7 in accordance with the voltage on node 39; a p channel MOS transistor Q28 for suppressing the increase of voltage on node 7; and a second internal voltage generating circuit 24 for setting the gate potential of MOS transistor Q28. The first internal voltage generating circuit 22 includes an n channel MOS transistor Q41 receiving at its gate the voltage on node 39 and operating in the source follower mode; p channel MOS transistors Q42 and Q43 connected in series between MOS transistor Q41 and each operating in the diode mode; and an n channel MOS transistor Q46 for transmitting the voltage on node 41 to node 7 in the source follower mode. The drains of MOS transistors Q41 and Q46 are connected to the boosted node 5. The drains of MOS transistors Q35 and Q46 may be coupled to the power supply node 1 to which the power supply voltage VCC is applied.

The second internal voltage generating circuit 24 includes an n channel MOS transistor Q44 and a p channel MOS transistor Q45 connected in series between nodes 41 and 48 and each operating in the diode mode, and a resistance element R2 having a high resistance connected between node 48 and the ground node. The resistance value of resistance element R2 is made sufficiently larger than the conduction resistances (channel resistances) of MOS transistors Q41 to Q45. The operation will now be described.

The voltage V39 on node 39 is given by the following equation.

V39=Vref+|VTP|+2·VTN

MOS transistor Q41 operates in the source follower mode, and transmits the voltage V39 on node 39 while lowering the same by the threshold voltage VTN. Transistors Q42 and Q43 both operate in the diode mode. Therefore, the voltage V41 on node 41 can be given by the following equation.

$$\begin{aligned} V41 &= V39 - VTN - 2\,|VTP| \\ &= Vref + VTN - |VTP| \end{aligned}$$

The MOS transistor Q46 operates in the source follower mode, and transmits the voltage on node 41 node 7 while lowering the same by threshold voltage VTN. Therefore, the voltage V7 on node 7 can be given by the following equation.

$$\begin{aligned} V7 &= V41 - VTN \\ &= Vref - |VTP| \end{aligned}$$

Meanwhile, MOS transistors Q44 and Q45 operate in the diode mode, and hence the voltage V48 on node 48 can be given by the following equation.

$$\begin{aligned} V48 &= V41 - VTN - |VTP| \\ &= Vref - 2\,|VTP| \end{aligned}$$

MOS transistor Q28 is rendered conductive when the voltage V7 on node 7 becomes higher than Vref−|VTP| and lowers the voltage V7 on node 7. Therefore, the voltage V7 on node 7 is stably maintained at a prescribed voltage level. MOS transistor Q11 is rendered conductive when the voltage VINT on output node 4 becomes higher than the reference voltage Vref, and lowers the voltage level of internal voltage VINT. Therefore, the voltage VINT from output node 4 can be maintained stably at a constant voltage level of the reference voltage Vref.

In the structure shown in FIG. 15, the gate of MOS transistor Q11 is coupled to boosted node 5 (or power supply node 1) through one stage of MOS transistor Q46. Therefore, similar to the effect of MOS transistor Q35 included in the first internal reference voltage generating circuit 10, the voltage on node 7 can be increased at high speed after power on. Therefore, MOS transistor Q11 can be turned off immediately after power on, and the internal voltage VINT on output node 4 can be quickly raised to the prescribed voltage level.

Here, the absolute value of the threshold voltage of MOS transistor Q11 may be set larger than that of MOS transistors Q42, Q43, Q28 and Q1. The through current flowing from power supply node 1 to the ground node through MOS transistors Q2 and Q11 can be surely suppressed.

As described above, according to the eighth embodiment of the present invention, the gate of output MOS transistor Q2 for charging the output node and the gate of the second output MOS transistor Q11 for discharging the output node 4 are both coupled to the power supply node (or boosted node) through one stage of MOS transistor, the gate potentials of these output MOS transistors Q2 and Q11 can be increased at high speed after power on, rise of the internal voltage VINT at output node 4 can be speeded up accordingly, and hence stable internal voltage VINT can be generated immediately after power on.

[Ninth Embodiment]

Figure 16:
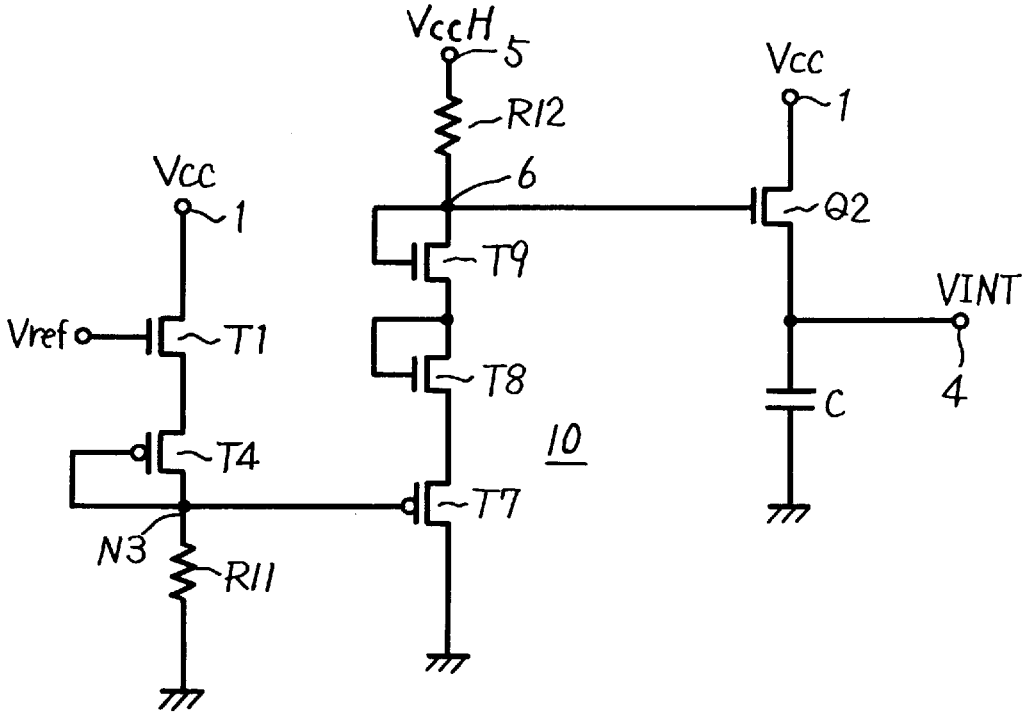
FIG. 16 shows a structure of an internal power supply circuit in accordance with a ninth embodiment of the present invention.

FIG. 16 shows a structure of an internal power supply circuit in accordance with the ninth embodiment of the present invention.

Referring to FIG. 16, the internal power supply circuit includes an n channel MOS transistor T1 receiving at its gate the reference voltage Vref and operating in the source follower mode; an n channel MOS transistor T4 for transmitting the voltage generated by MOS transistor T1 in the diode mode to node N3; an internal reference voltage generating circuit 10 for generating a reference voltage from the voltage on node N3; and an n channel MOS transistor Q2 coupled between the power supply node 1 and the output node 4, and receiving at its gate the second reference voltage which is generated by the internal reference voltage generating circuit 10 and transmitted to node 6. Node N3 is coupled to the ground node through a resistance element R11 having high resistance.

Internal reference voltage generating circuit 10 includes a p channel MOS transistor T7 transmitting the voltage on node N3 in the source follower mode, and n channel MOS transistors T8 and T9 connected in series between MOS transistor T7 and node 6 and each operating in the diode mode. Node 6 is connected to the boosted node 5 through a resistance element R12 having high resistance. The drain of MOS transistor T1 is connected to power supply node 1. This is because the MOS transistor T1 generates a voltage lower than the reference voltage Vref. The node 6 is coupled to the boosted node 5 through resistance element R12, because a voltage higher than the reference voltage Vref is transmitted to node 6, and a second reference voltage having a prescribed voltage should be stably generated even when the difference between power supply voltage VCC and the reference voltage Vref is small. The operation of the internal power supply circuit shown in FIG. 16 will now be described.

Resistance element R11 has a resistance value sufficiently larger than the conduction resistances (channel resistances)

of MOS transistors T1 and T4. MOS transistor T1 operates in the source follower mode, and lowers the reference voltage Vref applied to the gate thereof by the threshold voltage VTN for transmission. MOS transistor T4 operates in the diode mode, and lowers the voltage from MOS transistor T1 further by the absolute value |VTP| of the threshold voltage. Therefore, the voltage V3 on node N3 can be given by the following equation.

V3=Vref−VTN−|VTP|

The conduction resistances (channel resistances) of MOS transistors T7 to T9 are set sufficiently smaller than the resistance value of resistance element R12. Therefore, MOS transistor T7 operates in the source follower mode, and increases the voltage V3 applied to its gate by the absolute value of the threshold voltage. MOS transistors T8 and T9 operate in the diode mode, and respectively generate voltage drops of the threshold voltage VTN. Therefore, the voltage V6 on node 6 can be represented by the following equation.

$$\begin{aligned} V6 &= V3 + |VTP| + 2 \cdot VTN \\ &= Vref + VTN \end{aligned}$$

Since MOS transistor Q2 operates in the source follower mode, the internal voltage VINT transmitted to output node 4 becomes equal to the reference voltage Vref. When the internal voltage VINT at output node 4 lowers, the gate-source voltage of MOS transistor Q2 becomes larger than the threshold voltage VTN, and MOS transistor Q2 supplies current from power supply node 1 to output node 4, and increases the internal voltage VINT.

In the structure shown in FIG. 16 also, the internal reference voltage generating circuit 10 has a function of canceling the influence of the threshold voltages of MOS transistors Q2 and T1 on the internal voltage VINT, and therefore even when there is variation of manufacturing parameters or the like, the internal voltage VINT having a prescribed voltage level can be stably generated. As in the embodiments above, the output MOS transistor Q2 operates in the source follower mode, the comparing circuit for comparing the internal voltage VINT and the reference voltage Vref is not necessary, and hence power consumption can be reduced.

[Tenth Embodiment]

Figure 17:
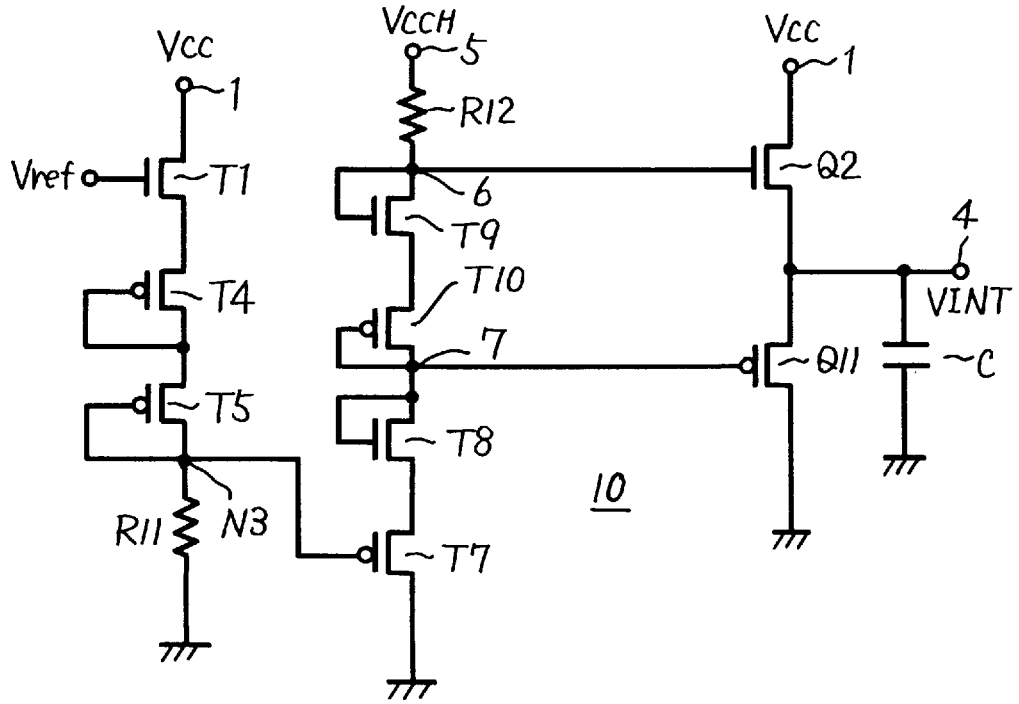
FIG. 17 shows a structure of an internal power supply circuit in accordance with a tenth embodiment of the present invention.

FIG. 17 shows a structure of an internal power supply circuit in accordance with the tenth embodiment of the present invention.

In the internal power supply circuit shown in FIG. 17, in addition to the structure shown in FIG. 16, a p channel MOS transistor Q11 for discharging output node 4, a p channel MOS transistor T5 for setting the gate potential of p channel MOS transistor Q11 and a p channel MOS transistor T10 for canceling the influence of the threshold voltage |VTP| of the p channel MOS transistor T5 on the voltage value of the internal voltage VINT are provided.

MOS transistor T5 is connected between MOS transistor T4 and node N3 and operates in the diode mode. MOS transistor T1O is connected between MOS transistors T8 and T9, and operates in the diode mode. The drain node (node 7) of MOS transistor T8 is coupled to the gate of output MOS transistor Q11. Other structure is the same as that shown in FIG. 16, and corresponding portions are denoted by the same reference characters. The operation will now be described.

The resistance value of resistance element R11 is sufficiently larger than the conduction resistances (channel resistances) of MOS transistors T1, T4 and T5. Therefore, the potential V3 on node N3 is given by the following equation.

V3=Vref−VTN−2 |VTP|

The resistance value of resistance element R12 is sufficiently larger than the conductive resistances (channel resistances) of MOS transistors T7 to T10. Therefore, the gate-source voltages of MOS transistors T7 to T10 are equal to the absolute values of the threshold voltages respectively. Therefore, the voltages V6 and V7 on nodes 6 and 7 can be given by the following equations.

$$\begin{aligned} V7 &= V3 + |VTP| + VTN \\ &= Vref - |VTP| \\ V6 &= V7 + |VTP| + VTN \\ &= Vref + VTN \end{aligned}$$

Therefore, since MOS transistors Q2 and Q11 operate in the source follower mode, the voltage VINT on output node 4 comes to have the voltage level of reference voltage Vref. More specifically, if the internal voltage VINT becomes higher than the reference voltage Vref, MOS transistor Q11 is rendered conductive, and lowers the voltage VINT. Meanwhile, if the internal voltage VINT lowers, MOS transistor Q2 is rendered conductive, supplies current from power supply node 1 to output node 4, and increases the internal voltage VINT.

In the structure shown in FIG. 17 also, the absolute value of the threshold voltage of MOS transistor Q11 may be set larger than the absolute value of the threshold voltages of MOS transistors T4 and T5. Generation of the through current flowing from the power supply node to the ground node can be prevented.

As described above, according to the tenth embodiment of the present invention, output MOS transistors each operating in the source follower mode are provided for the output node, a constant internal reference voltage is applied to the gates of these MOS transistors, and the constant internal reference voltage is adapted not to be influenced by the threshold voltage of the MOS transistor receiving at its gates the reference voltage Vref and the threshold voltage of the output MOS transistor on the internal voltage VINT. Therefore, an internal voltage VINT having a prescribed voltage level can be generated stably at low current consumption.

[Eleventh Embodiment]

Figure 18:
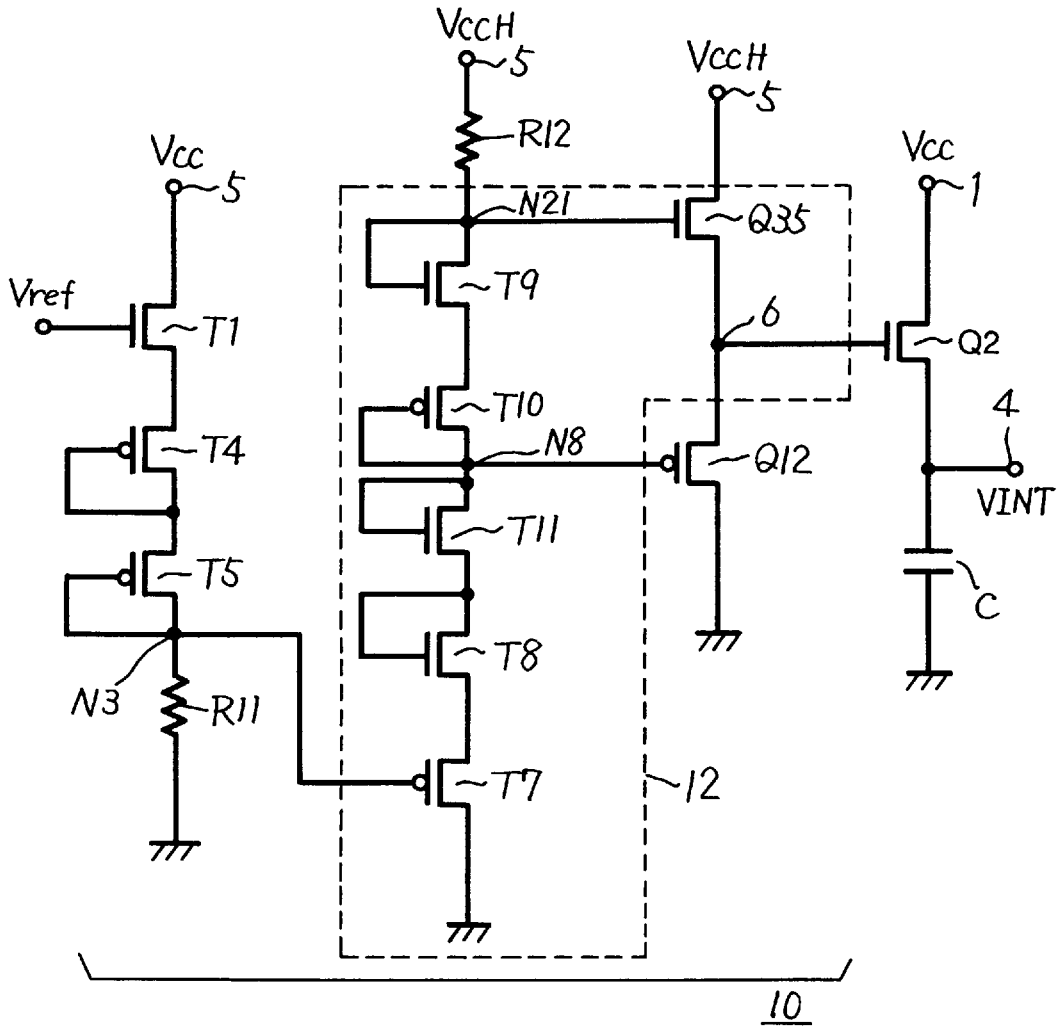
FIG. 18 shows a structure of an internal power supply circuit in accordance with an eleventh embodiment of the present invention.

FIG. 18 shows a structure of an internal power supply circuit in accordance with the eleventh embodiment of the present invention. Referring to FIG. 18, the internal power supply circuit differs from the structure of FIG. 17 in that the internal voltage generating circuit included in the internal reference voltage generating circuit 10 for generating a second reference voltage from the voltage on the first internal node N3 receiving an internal voltage generated in accordance with the first reference voltage Vref and applying the thus generated second reference voltage to the gates of the output MOS transistor Q1 has a different structure. Except that the internal voltage generating circuit 12 has a different structure and the output MOS transistor Q11 for discharging the output node 4 is not provided, the structure of the internal power supply circuit shown in FIG. 18 is the same as that of the internal power supply circuit shown in FIG. 17, and corresponding portions are denoted by the same reference characters.

Internal voltage generating circuit 12 includes a p channel MOS transistor T7 receiving at its gate the voltage on node N3 and operating in the source follower mode; n channel MOS transistors T8 and T11 connected in series between MOS transistor T7 and node N8 and each operating in the diode mode; and a p channel MOS transistor T10 and an n channel MOS transistor T9 connected in series between nodes N8 and N21 and each operating in the diode mode. The positions of MOS transistors T9 and T10 may be exchanged. Node N21 is coupled to the boosted node 5 through resistance element R12 having high resistance.

The internal voltage generating circuit 12 further includes an n channel MOS transistor Q35 coupled between the boosted node 5 and internal node 6 and having its gate coupled to node N21, and a p channel MOS transistor Q12 coupled between node 6 and the ground node and having its gate coupled to node N8. Conduction resistances (channel resistances) of MOS transistors T7 to T11 are set sufficiently smaller than the resistance value of resistance element R12. Therefore, gate-source voltage of these MOS transistors T7 to T11 are set equal to the absolute values of the threshold voltages respectively. MOS transistors Q35 and Q12 operate in the source follower mode. The operation will now be described.

The voltage V3 on node N3 is the same as that of the embodiment shown in FIG. 17. The MOS transistor T7 operates in the source follower mode, and MOS transistors T8 and T11 operate in the diode mode. Therefore, the voltage V8 on node N8 can be given by the following equation.

$$\begin{aligned} V8 &= V3 + |VTP| + 2 \cdot VTN \\ &= Vref + VTN - |VTP| \end{aligned}$$

The voltage V8 on node N8 is applied to the gate of MOS transistor Q12. Therefore, MOS transistor Q12 is rendered conductive when the voltage V6 on node 6 becomes higher than Vref+VTN, and lowers the voltage V6 on node 6. Therefore, even when the voltage V6 on node 6 increases because of the influence of noise, for example, the voltage level on node N6 can be immediately lowered to the prescribed voltage level.

MOS transistors T9 and T10 between nodes N8 and N21 operate in the diode mode, and hence the voltage V21 on node N21 can be given by the following equation.

$$\begin{aligned} V21 &= V8 + |VTP| + VTN \\ &= Vref + 2 \cdot VTN \end{aligned}$$

Node N21 is coupled to the gate of MOS transistor Q35. The voltage on node N21 is lower than the high voltage VCCH on boosted node 5. Therefore, MOS transistor Q35 operates in the source follower mode, and voltage V6 on node 6 is represented by V6=Vref+VTN Node 6 is coupled to the gate of output MOS transistor Q1. Since the voltage VCC at power supply node 1 is higher than the internal voltage VINT, the conduction terminal connected to the output node 4 of MOS transistor Q1 serves as a source. Therefore, when the internal voltage VINT lowers by the threshold voltage VTN than the voltage V6 at node 6, MOS transistor Q1 is rendered conductive and supplies current from power supply node 1 to output node 4. Meanwhile, if the difference between internal voltage VINT on output node 4 and voltage V6 on node 6 becomes smaller than the threshold voltage VTN, MOS transistor Q1 is turned off. Therefore, the voltage VINT on output node 4 becomes equal to the reference voltage Vref.

In the structure shown in FIG. 18 also, internal node 6 is connected to boosted node 5 through one stage of MOS transistor Q35. Therefore, when the power is on, the voltage on node 6 increases immediately, MOS transistor Q1 is rendered conductive responsively, and increases the internal voltage VINT at output node 4 at high speed after power on. Therefore, the internal voltage VINT can attain the prescribed voltage level immediately after power on.

The drain of MOS transistor Q35 may be coupled not to the boosted node 5 but to the power supply node 1.

As described above, according to the eleventh embodiment of the present invention, since the gate of the output MOS transistor Q1 is coupled to the boosted node (or power supply node) through one stage of MOS transistor, the gate potential of the output MOS transistor can be increased immediately after power on, and accordingly, the internal voltage VINT can be increased to the prescribed voltage level at high speed after power on.

Further, even when the gate potential on output MOS transistor Q1 increases because of the influence of noise, for example, quick discharge is performed by the MOS transistor Q12, and hence the gate potential of MOS transistor Q1 can be prevented from being kept high for excessively long period of time. Therefore, increase of the internal voltage VINT according to the increase in the potential at internal node 6 can be prevented, and internal voltage VINT of a constant voltage level can be generated stably.

[Embodiment 12]

Figure 19:
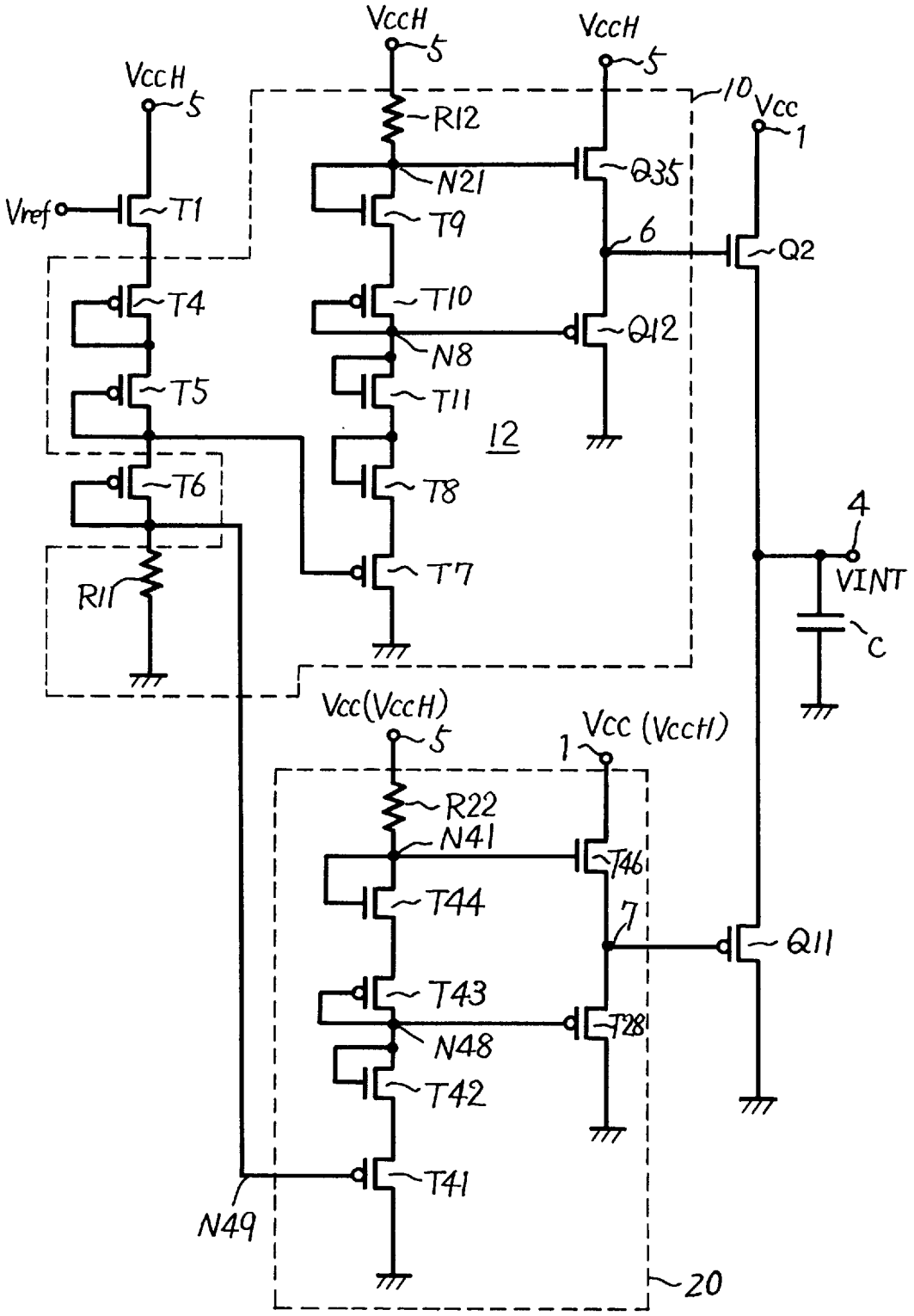
FIG. 19 shows a structure of an internal power supply circuit in accordance with a twelfth embodiment of the present invention.
Figure 20:
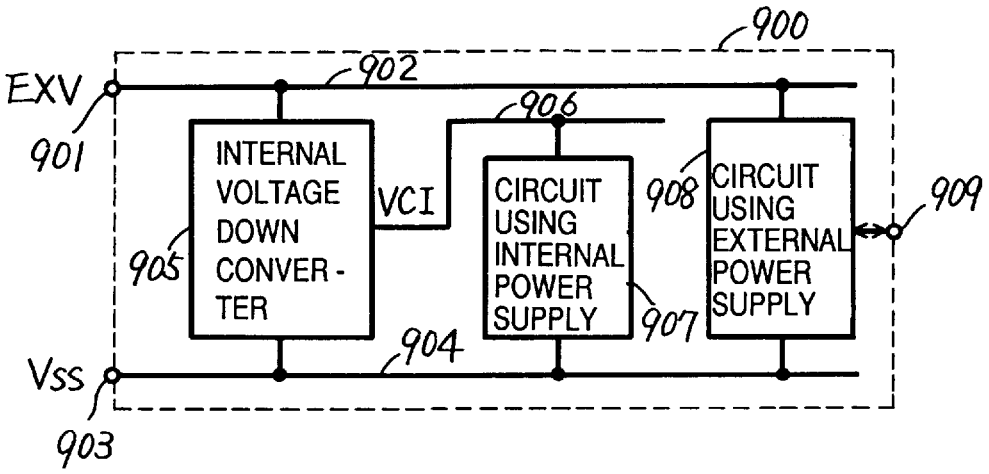
FIG. 20 PRIOR ART
FIG. 20 schematically shows an internal structure of a conventional semiconductor device.
Figure 21:
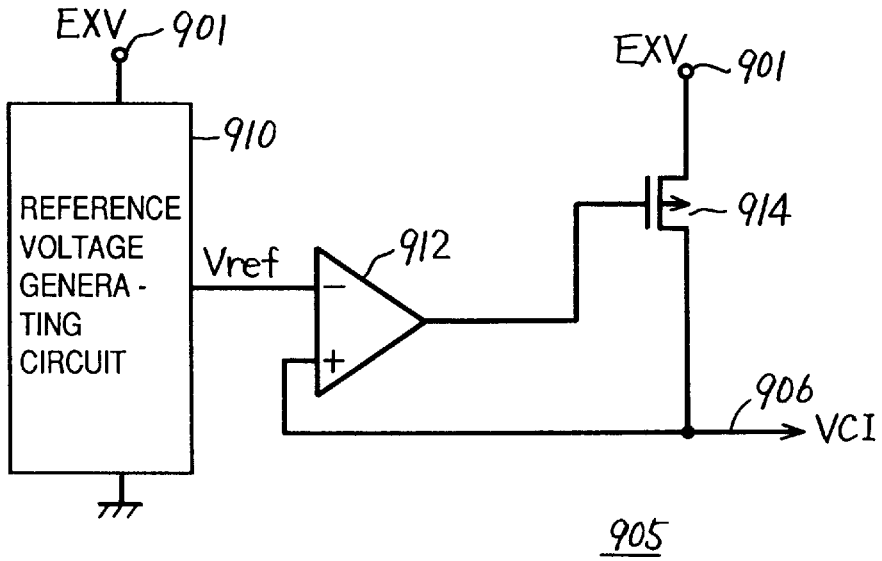
FIG. 21 PRIOR ART
FIG. 21 shows a structure of a conventional internal power supply voltage generating circuit.
Figure 22:
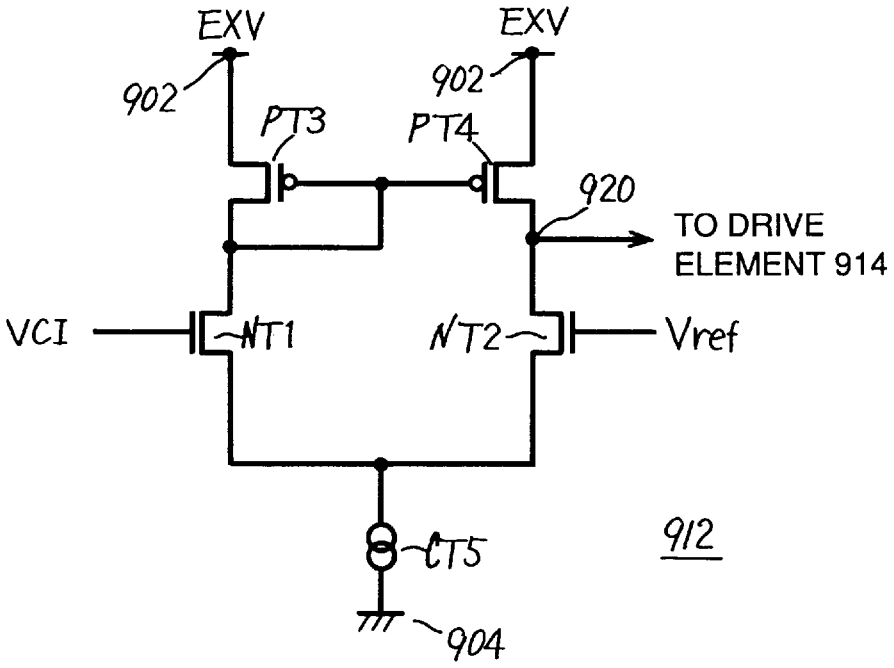
FIG. 22 PRIOR ART
FIG. 22 shows an example of a structure of a comparator shown in FIG. 21.

FIG. 19 shows a structure of an internal power supply circuit in accordance with the twelfth embodiment of the present invention. Referring to FIG. 19, the structure of the first internal reference voltage generating circuit 10 for setting the potential of the gate of n channel MOS transistor Q1 coupled between the power supply node 1 and output node 4 is the same as the structure of the first internal reference voltage generating circuit 10 shown in FIG. 18. Therefore, corresponding portions are denoted by the same reference characters and detailed description is not repeated.

Referring to FIG. 19, a second internal reference voltage generating circuit 20 for setting the gate potential of a p channel MOS transistor Q11 coupled between output node 4 and ground node is further provided. In order to generate an internal voltage of a prescribed voltage level for the second internal reference voltage generating circuit 20, a p channel MOS transistor T6 operating in the diode mode is provided between resistance element R11 and the MOS transistor T5 in the first internal reference voltage generating circuit 10. MOS transistor T6 has its drain coupled to node N49. Conduction resistance (channel resistance) of MOS transistor T6 is set sufficiently smaller than the resistance value of resistance element R11, and hence MOS transistor T6 lowers the voltage received from MOS transistor T5 by the absolute value of the threshold voltage, for transmission to node N49.

The second reference voltage generating circuit 20 includes a p channel MOS transistor T41 receiving at its gate the voltage on node N49 and operating in the source follower mode; an n channel MOS transistor T42 connected between MOS transistor T41 and node N48 and operating in the diode mode; a p channel MOS transistor T43 and an n channel MOS transistor T44 connected in series between nodes N41 and N48 and each operating in the diode mode; a resistance element R22 having high resistance connected between node N41 and boosted node 5; an n channel MOS transistor T46 receiving at its gate the voltage on node N41 operating in the source follower mode, and coupled between power supply node 1 and node 7; and a p channel MOS transistor T28 connected between node 7 and the ground node and having its gate connected to node N48. MOS transistor T28 operates in the source follower mode.

The resistance value of resistance element R22 is sufficiently larger than the conduction resistances (channel resistances) of MOS transistors T41 and T44. Therefore, MOS transistors T41 to T44 have their gate-source voltages made equal to the absolute values of the threshold voltages, respectively. The operation will now be described.

To node N49, the voltage V49 represented by the following equation is transmitted from MOS transistor T6.

V49=Vref−3 |VTP|−VTN

By MOS transistors T41 and T42, the potential V48 on node N48 can be given by the following equation.

$$\begin{aligned} V48 &= V49 + |VTP| + VTN \\ &= Vref - 2|VTP| \end{aligned}$$

MOS transistor T28 has its drain coupled to the ground node, and maintains the potential difference between nodes 7 and N48 at the absolute value of the threshold voltage thereof. More specifically, if the voltage V7 at node 7 becomes higher than Vref−|VTP|, MOS transistor T28 is rendered conductive. Therefore, when the voltage on node N7 increases by the influence of noise, for example, the gate potential of MOS transistor Q11 can be prevented from being kept at an increased level for excessively long period of time. Therefore, when the internal voltage VINT increases, the internal voltage VINT can be maintained surely at the prescribed voltage (Vref).

Meanwhile, to node N41, the voltage V41 represented by the following equation is transmitted by MOS transistors T43 and T44 operating in the diode mode.

$$\begin{aligned} V41 &= V48 + VTN + |VTP| \\ &= Vref + VTN - |VTP| \end{aligned}$$

The gate potential of MOS transistor T46 is lower than the potential at the drain thereof (power supply node 1), and hence MOS transistor T46 operates in the source follower mode. Therefore, MOS transistor T46 transmits the voltage V7 represented by the following equation to node 7.

$$\begin{aligned} V7 &= V41 - VTN \\ &= Vref - |VTP| \end{aligned}$$

By MOS transistors T46 and T28, it is possible to maintain the voltage V7 at node 7 at a constant voltage level Vref−|VTP|.

In the structure shown in FIG. 19, in addition to the effect of the structure of the eleventh embodiment shown in FIG. 18, the potential at node 7 can be increased at high speed by means of one stage of MOS transistor T46 when the power is turned on, and accordingly, MOS transistor Q11 can be turned off at an earlier timing after power on. Therefore, it becomes possible to charge the output node 4 at high speed through MOS transistor Q1 after power on, and the internal voltage VINT can reach the prescribed voltage level at high speed.

As described above, according to the twelfth embodiment of the present invention, since the gates of output MOS transistors Q1 and Q11 are coupled to the power supply node or the boosted node through one stage of MOS transistor, the gate potentials can be increased at high speed after power on, and accordingly, the internal voltage can reach the constant voltage level at high speed.

The internal reference voltage generating circuit cancels the influence of the threshold voltages of these MOS transistors and the threshold voltage of the MOS transistor receiving at its gate the reference voltage Vref on the internal voltage VINT output from the output MOS transistor, whereby a reference voltage of a prescribed voltage level can be stably generated, not influenced by the manufacturing parameters.

Resistance element R22 may be coupled to power supply node 1. The drain of MOS transistor T46 may be coupled to boosted node 5. The drain of MOS transistor Q35 may be coupled to power supply node 1.

As described above, according to the present invention, since MOS transistor is operated in a diode mode or a source follower mode, which operation mode can be realized with low current consumption, hence internal voltage circuit consuming a very little current can be realized. Further, influences of the threshold voltages of the MOS transistors, which are the components, on the output voltage are all canceled, and hence an internal voltage of a desired voltage level can be generated stably without any influence of deviation in the threshold voltage.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal power supply circuit, comprising:

a first insulated gate type field effect transistor of a first conductivity type receiving at a gate thereof a first reference voltage and having one conduction terminal and another conduction terminal coupled to receive a predetermined voltage;

at least one second insulated gate type field effect transistor connected between the one conduction terminal of said first insulated gate type field effect transistor and a first internal node, said at least one second insulated gate type field effect transistor each being diode connected;

an output insulated gate type field effect transistor connected between a power supply node and an internal voltage output node, for forming a current path between said power supply node and said internal voltage output node in accordance with a voltage applied to a gate thereof; and internal reference voltage generating means for generating a second reference voltage from the voltage on said first internal node and for applying said second reference voltage to the gate of said output insulated gate type field effect transistor, said internal reference voltage generating means including means for canceling influence of threshold voltages of said first, second and output insulated gate type field effect transistors on a voltage value output at said internal voltage output node.

2. An internal power supply circuit, comprising;

a first p channel insulated gate type field effect transistor having a gate receiving a first reference voltage, one conduction terminal coupled to receive a ground potential, and another conduction terminal;

an n channel output insulated gate type field effect transistor connected between a power supply node and an internal voltage output node, for supplying a current from said power supply node to said internal voltage output node for generating an internal voltage; and internal reference voltage generating means for generating a second reference voltage from the voltage on the other conduction terminal of the first p channel transistor for application to a gate of said output insulated gate type field effect transistor, said internal reference voltage generating means including at least one second n channel insulated gate type field effect transistor connected between said another conduction terminal of said first p channel insulated gate type field effect transistor and a first internal node, and each operating in a diode mode, and means for canceling influence of threshold voltages of said first, second and output insulated gate type field effect transistors on a voltage value of said internal voltage.

3. The internal power supply circuit according to claim 2, wherein said cancellation means includes an n channel source follower insulated gate type field effect transistor receiving at a gate thereof a voltage on said first internal node transmitting the received voltage in a source follower mode, and a diode connected p channel insulated gate type field effect transistor coupled to said source follower insulated gate type field effect transistor and generating said second reference voltage from the voltage transmitted in said source follower mode.

4. An internal power supply circuit according to claim 2, wherein said second n channel insulated gate type field effect transistor is coupled through a high resistance element to a boosted node to which a high voltage higher than a voltage applied to said power supply node is applied, and said internal reference voltage generating means is coupled to receive a current from said boosted node.

5. An internal power supply circuit according to claim 2, further comprising:

a p channel second output insulated gate type field effect transistor coupled between said internal voltage output node and a ground node supplying said ground potential; and second internal reference voltage generating means including means for canceling influence of threshold voltage of the first p channel and second n channel transistors and of said second output insulated gate type field effect transistor on said internal voltage, for generating a third reference voltage from said first reference voltage and for applying the generated third reference voltage to a gate of said second output insulated gate type field effect transistor.

6. An internal power supply circuit according to claim 2, further comprising:

discharging means receiving a gate potential of said first output insulated gate type field effect transistor and a potential on said first internal node, for discharging the gate of said first output insulated gate type field effect transistor to the ground potential level, in response to the gate potential of said first output insulated gate type field effect transistor attaining a level higher than said first reference voltage.

7. The internal power supply circuit according to claim 2, comprising:

a p channel discharging insulated gate type field effect transistor coupled between the gate of said first output insulated gate type field effect transistor and the ground node; and transmitting means for lowering the potential on said first internal node to said second reference voltage further less an absolute value of a threshold voltage of said discharging insulated gate type field effect transistor, and for transmitting the lowered potential to a gate of said discharging insulated gate type field effect transistor.

8. The internal power supply circuit according to claim 2, further comprising:

a p channel second output insulated gate type field effect transistor coupled between said internal voltage output node and the ground node; and second internal reference voltage generating means including means canceling an influence of threshold voltages of said n channel output insulated gate type field effect transistor and said second output insulated gate type field effect transistor on a voltage value of the internal voltage at said internal voltage output node, for generating a third reference voltage from a voltage output from said first p channel insulated gate type field effect transistor and applying the generated third reference voltage to a gate of said second output insulated gate type field effect transistor.

9. An internal power supply circuit, comprising:

a p channel first insulated gate type field effect transistor receiving at a gate thereof a first reference voltage, configured as a source follower and generating a second reference voltage higher than said first reference voltage at a source thereof;

an n channel output insulated gate type field effect transistor coupled between a power supply node and an internal voltage output node receiving at a gate thereof the second reference voltage at the source of said first insulated gate type field effect transistor and configured as a source follower, for supplying a current from a power supply node to an internal voltage output node; and a resistance element coupled between said source of said first insulated gate type field effect transistor and a node receiving a voltage higher than a voltage applied to said power supply node.

10. The internal power supply circuit according to claim 9, further comprising:

a p channel second output insulated gate type field effect transistor coupled between said internal voltage output node and a ground node and configured as a source follower; and internal reference voltage generating means coupled to receive the second reference voltage for generating a third reference voltage lower than said second reference voltage for application to a gate of said second output insulated gate type field effect transistor.

11. The internal power supply circuit according to claim 9, wherein said resistance element is formed of a p channel insulated gate type field effect transistor.

12. The internal power supply circuit according to claim 2, wherein said internal reference voltage generating means further includes an n channel first source follower insulated gate type field effect transistor receiving at a gate thereof a voltage on said first internal node and operating in a source follower mode, a p channel insulated gate type field effect transistor operating in a diode mode, for lowering a voltage transmitted by said first source follower insulated gate type field effect transistor, and an n channel second source follower insulated gate type field effect transistor receiving at a gate thereof an output voltage from said p channel insulated gate type field effect transistor operating in the diode mode, operating in a source follower mode to generate said second reference voltage.

13. The internal power supply circuit according to claim 12, further comprising a p channel second insulated gate type field effect transistor coupled between said internal voltage output node and a ground node, and second internal reference voltage generating means coupled to receive an output voltage generated from said first insulated gate type field effect transistor for generating a third reference voltage lower than the output voltage received from said first insulated gate type field effect transistor for application to the gate of said second output insulated gate type field effect transistor, said internal reference voltage generating means including means for canceling influence of threshold voltages of said first insulated gate type field effect transistor and said second output insulated gate type field effect transistor on a value of said internal voltage.

14. An internal power supply circuit, comprising:

an n channel first insulated gate type field effect transistor receiving at a gate thereof a first reference voltage for transmission to a source thereof in a source follower mode so as to lower said first reference voltage and having a drain coupled to receive a predetermined voltage;

an n channel first output insulated gate type field effect transistor coupled between a power supply node and an internal voltage output node and operating in the source follower mode and having a gate; and a first internal reference voltage generating means for generating a second reference voltage higher than said first reference voltage from a voltage transmitted from the source of said first insulated gate type field effect transistor, for application to the gate of said first output insulated gate type field effect transistor, said first internal reference voltage generating means including means for canceling an influence of threshold voltages of said first insulated gate type field effect transistor and said first output insulated gate type field effect transistor on a value of the internal voltage on said internal voltage output node.

15. The internal power supply circuit according to claim 14, wherein said first internal reference voltage generating means includes a p channel first lowering insulated gate type field effect transistor operating in a diode mode, for receiving and lowering the output voltage from the source of said first insulated gate type field effect transistor;

a p channel first source follower insulated gate type field effect transistor receiving at a gate thereof the output voltage of said first lowering insulated gate type field effect transistor, for transmission in the source follower mode to a source thereof to increase the received voltage; and n channel insulated gate type field effect transistors connected in series between the source of said first source follower insulated gate type field effect transistor and the gate of said first output insulated gate type field effect transistor, each operating in a diode mode, for further increasing the voltage transmitted at the source of said first source follower insulated gate type field effect transistor and for outputting said second reference voltage.

16. The internal power supply circuit according to claim 14, wherein said first internal reference voltage generating means includes first potential lowering means consisting of a plurality of p channel insulated gate type field effect transistors connected in series between the source of said first insulated gate type field effect transistor and a first internal node, and each operating in a diode mode, for receiving and lowering the output voltage from the source of said first insulated gate type field effect transistor for outputting to the first internal node;

a p channel first source follower insulated gate type field effect transistor receiving at a gate thereof the voltage on said first internal node for transmission in the source follower mode to a source thereof for increasing the received voltage at the gate thereof; and potential increasing means having a plurality of n channel insulated gate type field effect transistors and at least one p channel insulated gate type field effect transistor connected in series between the gate of said first output insulated gate type field effect transistor and the source of said first source follower insulated gate type field effect transistor, and each operating in the diode mode, the number of p channel insulated gate type field effect transistors in said potential increasing means being smaller by one than the plurality of p channel insulated gate type field effect transistors operating in the diode mode included in said first potential lowering means.

17. The internal power supply circuit according to claim 14, wherein said internal reference voltage generating means includes:

a plurality of p channel insulated gate type field effect transistors connected in series between the source of said first insulated gate type field effect transistor and a first internal node, each operating in a diode mode for lowering the output voltage from the source of said first insulated gate type field effect transistor for application onto said first internal node;

a p channel first source follower insulated gate type field effect transistor, receiving at a gate thereof the voltage on said first internal node for transmission to a source thereof in the source follower mode for increasing the received voltage at the gate thereof;

a plurality of diode connected n channel insulated gate type field effect transistors connected in series to each other between a second internal node and the source of said first source follower insulated gate type field effect transistor, each operating in the diode mode, for increasing the output voltage at the source of said first source follower insulated gate type field effect transistor for application to said second node;

an n channel insulated gate type field effect transistor and a p channel insulated gate type field effect transistor connected in series to each other between said second internal node and a third internal node and each operating in the diode mode, for increasing the voltage on the second node for transmission to the third node; and an n channel insulated gate type field effect transistor receiving at a gate thereof the potential at said third internal node for transmission to a source thereof in the source follower mode to generate said second reference voltage.

18. The internal power supply circuit according to claim 14, further comprising:

a p channel second output insulated gate type field effect transistor coupled between said internal voltage output node and a ground node supplying another power supply potential and having a gate; and second internal reference voltage generating means for generating a third reference voltage lower than said second reference voltage from the output voltage received from the source of said first insulated gate type field effect transistor for application to the gate of said second output insulated gate type field effect transistor, said second internal reference voltage generating means including means for canceling an influence of threshold voltages of said first insulated gate type field effect transistor and said second output insulated gate type field transistor on a value of the voltage appearing at said internal voltage output node.

19. The internal power supply circuit according to claim 14, wherein said first insulated gate type field effect transistor has the drain coupled to a node receiving a voltage higher than a voltage at said power supply node, and said first internal voltage generating means is coupled to receive a current flow from a node supplying said voltage higher than the voltage at said power supply node.

* * * * *